US010762884B2

(12) United States Patent
Suzuki

(10) Patent No.: US 10,762,884 B2
(45) Date of Patent: Sep. 1, 2020

(54) KEYBOARD DEVICE FOR ELECTRONIC KEYBOARD INSTRUMENT AND KEYFRAME FRONT FOR KEYBOARD INSTRUMENT

(71) Applicant: KABUSHIKI KAISHA KAWAI GAKKI SEISAKUSHO, Hamamatsu-shi, Shizuoka-ken (JP)

(72) Inventor: Akihiro Suzuki, Hamamatsu (JP)

(73) Assignee: KABUSHIKI KAISHA KAWAI GAKKI SEISAKUSHO, Hamamatsu-Shi, Shizuoka (JP)

( * ) Notice: Subject to any disclaimer, the term of this patent is extended or adjusted under 35 U.S.C. 154(b) by 0 days.

(21) Appl. No.: 16/552,220

(22) Filed: Aug. 27, 2019

(65) Prior Publication Data

US 2020/0074968 A1 Mar. 5, 2020

(30) Foreign Application Priority Data

Aug. 30, 2018 (JP) ..... 2015/161108
Aug. 30, 2018 (JP) ..... 2018/161106
Aug. 30, 2018 (JP) ..... 2018/161107

(51) Int. Cl.
*G10H 1/34* (2006.01)
*G10C 3/12* (2006.01)

(52) U.S. Cl.
CPC ..... *G10H 1/346* (2013.01); *G10C 3/12* (2013.01)

(58) Field of Classification Search
CPC ..... G10H 1/346; G10C 3/12
See application file for complete search history.

(56) References Cited

U.S. PATENT DOCUMENTS 4,217,803 A * 8/1980 Dodds ..... G10H 1/346 84/687
4,273,017 A * 6/1981 Dodds ..... G10H 1/346 84/687
5,821,443 A * 10/1998 Masubushi ..... G10H 1/346 84/433
6,191,351 B1 * 2/2001 Niitsuma ..... G10H 1/346 84/423 R (Continued)

FOREIGN PATENT DOCUMENTS

JP 2013-125236 A 6/2013
JP 5797074 B2 10/2015

*Primary Examiner* — Robert W Horn
(74) *Attorney, Agent, or Firm* — Lewis Roca Rothgerber Christie LLP

(57) ABSTRACT

A keyboard device for an electronic keyboard instrument, capable of suppressing bouncing of a hammer returning to its original position. A key extends in a front-rear direction swingably about a balance rail pin. The hammer is formed vertically pivotally movable between initial and pivotally-moved positions about a hammer fulcrum provided near a rear end of the key and is placed on the key via a key contact portion in contact with a rear end of upper surface of the key from above, for pivotal motion by swinging of the key. A hammer cushion is provided on upper surface of the key at a predetermined location forward of the key contact portion to suppress bouncing of the hammer by contact with a cushion contact portion of the hammer returning from the pivotally-moved position to the initial position by releasing the key depression.

14 Claims, 11 Drawing Sheets

(56) References Cited

U.S. PATENT DOCUMENTS

| | | | | |
|---|---|---|---|---|
| 6,248,943 | B1 * | 6/2001 | Inoue | G10C 3/12 84/423 R |
| 6,617,502 | B2 * | 9/2003 | Suzuki | G10C 3/16 84/423 R |
| 6,653,542 | B2 * | 11/2003 | Suzuki | G10C 3/12 84/423 R |
| 6,777,605 | B2 * | 8/2004 | Wenjun | G10C 3/16 84/409 |
| 7,514,613 | B2 * | 4/2009 | Yamaguchi | G10C 3/12 84/236 |
| 7,550,659 | B2 * | 6/2009 | Shimoda | G10C 3/12 84/251 |
| 7,750,222 | B2 * | 7/2010 | Osuga | G10C 3/12 84/423 R |
| 8,093,480 | B2 * | 1/2012 | Yoshida | G10H 1/346 84/439 |
| 8,481,841 | B2 * | 7/2013 | Shimoda | G10H 1/344 84/719 |
| 8,530,732 | B2 * | 9/2013 | Suzuki | G10H 1/346 84/243 |
| 8,552,280 | B2 * | 10/2013 | Ishida | G10H 1/346 84/433 |
| 8,748,725 | B2 * | 6/2014 | Iwase | G10H 1/346 84/433 |
| 8,766,075 | B2 * | 7/2014 | Ishida | G10H 1/34 84/423 R |
| 9,006,549 | B2 * | 4/2015 | Suzuki | G10H 1/34 84/423 R |
| 9,607,587 | B2 * | 3/2017 | Suzuki | G10H 1/34 |
| 9,899,014 | B2 * | 2/2018 | Nishimura | G10H 1/346 |
| 10,373,596 | B2 * | 8/2019 | Suzuki | G10H 1/346 |
| 2020/0074968 | A1 * | 3/2020 | Suzuki | G10H 1/346 |

* cited by examiner

KEYBOARD DEVICE FOR ELECTRONIC KEYBOARD INSTRUMENT AND KEYFRAME FRONT FOR KEYBOARD INSTRUMENT

CROSS-REFERENCE TO RELATED APPLICATION(S)

This application claims priority to Japanese Patent Application Numbers 161106/2018, filed on Aug. 30, 2018; 161107/2018 filed on Aug. 30, 2018; and 161108/2018 filed on Aug. 30, 2018, the entire contents of all of which are incorporated herein by reference

BACKGROUND OF THE INVENTION

Field of the Invention

The present invention relates to a keyboard device for an electronic keyboard instrument having swingable keys each extending in a front-rear direction, and more particularly to a keyboard device for an electronic keyboard instrument, which has hammers each of which performs vertical pivotal motion above a rear end of an associated key in accordance with the motion of the key, and to a structure of a portion of the hammer, which is brought into contact with the key when the hammer is pivotally moved upward by being pushed up by the rear end of the associated key, in the keyboard device, as well as to a keyframe front for a keyboard instrument, which is applied to a keyboard instrument, such as an electronic piano, so as to hold a front rail pin for engagement with a front end of an associated key, in an erected state.

Description of the Related Art

Conventionally, as a keyboard device of the above-mentioned type, there has been known, for example, one disclosed in Japanese Laid-Open Patent Publication (Kokai) No. 2013-125236 already filed by the present applicant. This keyboard device includes swingable keys each extending in the front-rear direction and hammers each vertically pivotally movably provided above a rear end of an associated one of the keys. Each of the keys is swingably supported on a balance rail pin erected at a location at about a longitudinal center of the key. On the other hand, each of the hammers is comprised of a hammer body made of a synthetic resin and formed in an arm-like shape extending in the front-rear direction, a pair of weight plates made of metal and attached to respective front ends of the left and right side surfaces of the hammer body, and a capstan screw screwed into a rear portion of the lower surface of the hammer body. The hammer body has a rear end formed with an arcuate shaft hole, and the shaft hole is engaged with a hammer fulcrum shaft of a hammer support, whereby the hammer is pivotally movably supported. Further, the capstan screw screwed in the hammer body has a lower end formed with a head having a lower surface formed into a spherical shape. The head of the capstan screw is in contact with a rear end of the upper surface of the key via cloth made of felt.

Further, conventionally, as a keyframe front for a keyboard instrument of the above-described type, there has been known, for example, one disclosed in Japanese Patent No. 5797074 filed by the present applicant. This keyframe front is formed by interconnecting a plurality of keyframe front molded articles each made of a synthetic resin such that the keyframe front extends in the left-right direction. Each of the keyframe front molded articles is comprised of a laterally elongated body part on which a plurality of front rail pins are erected at predetermined spaced intervals in the left-right direction and left and right connecting portions protruding from the respective left and right ends of the body part so as to connect the keyframe front molded article itself to left and right adjacent keyframe front molded articles, respectively. These left and right connecting portions have shapes substantially identical to each other in plan view, and while the left connecting portion has an upper half portion thereof cut out, the right connecting portion has a lower half portion thereof cut out. Further, the front end and the rear end of each of the left and right connecting portions have two screw holes, respectively, vertically extending therethrough, and a plurality of grooves extending parallel to each other in the left-right direction formed on the upper surface of the left connecting portion having its upper half cut out.

In the case of connecting adjacent two keyframe front molded articles to each other, first, the right connecting portion of one of the keyframe front molded articles and the left connecting portion of the other are vertically superposed one upon the other, and the front end and the rear end of the respective keyframe front molded articles are screwed to each other. Then, an adhesive is injected into a gap formed between the right end surface of the body part of the left one of the keyframe front molded articles screwed to each other and the left end surface of the left connecting portion of the right one of the keyframe front molded articles. The injected adhesive flows into each of the grooves formed on the left connecting portion of the right keyframe front molded article. As a consequence, the two keyframe front molded articles are connected to each other in a state in which the right connecting portion of the left one and the left connecting portion of the right one are joined by shiplap.

Further, the keyframe front formed by interconnecting the plurality of keyframe front molded articles as above is disposed along a front rail, which extends in the left-right direction, of a metal keyboard chassis and is screwed to the front rail at a plurality of portions.

In the keyboard device constructed as disclosed in Japanese Laid-Open Patent Publication (Kokai) No. 2013-125236, in a key-released state, the key is held in a posture slightly inclined downward and rearward, whereas the hammer is held in a substantially horizontal posture. The capstan screw is held with its axis inclined with respect to the vertical line. Specifically, the capstan screw is in a posture in which as a portion thereof is lower, the portion is positioned more rearward, i.e. the capstan screw is inclined downward and rearward. In this case, the front half of the lower surface of the head of the capstan screw is in contact with the rear end of the upper surface of the key. When the front end of the key is pushed down in this key-released state, the key swings about the balance rail pin, whereby the rear end of the key is raised. In accordance with this motion of the key, the hammer is pushed up via the capstan screw, thereby being pivotally moved upward about a hammer fulcrum shaft. Note that when the key is fully depressed, i.e. when the front end of the key is pushed down to its lowest position, the front end of the upper surface of the hammer is brought into abutment with a hammer stopper, whereby further pivotal motion of the hammer is blocked. Then, when the finger is released from the key being depressed, the hammer pivotally moved upward pivotally moves downward by its own weight and returns to its original position where the hammer was before the key depression. In this case, the rear end of the key is pushed down via the capstan screw in accordance with the downward pivotal motion of the hammer, and the key returns to its original position where it was before the key depression.

In the above-described keyboard device, when a hammer that pivotally moves downward in accordance with release of a depressed key is on the point of returning to its original position, the hammer can slightly bounce vertically due to a force generated by the pivotal motion of the hammer itself. The hammer is always held in contact with the key in a state placed on the rear end of the upper surface of the key via the capstan screw as described hereinabove, so that when the hammer bounces as above, the key swings in accordance with the bouncing of the hammer. More specifically, assuming that the key swings in accordance with the bouncing of the hammer on the point of returning to its original position, this prevents the depressed key from quickly returning to its original position where it was before the key depression, which sometimes causes trouble in musical performance.

Further, in a case where a hammer is pivotally moved upward in accordance with key depression of an associated key as described above, the posture of the capstan screw held in contact with the rear end of the upper surface of the key changes. Specifically, the head of the lower end of the capstan screw moves forward relative to the upper end of the same, whereby the capstan screw is brought into a posture inclined downward and forward. In this case, the rear half of the lower surface of the head of the capstan screw is in contact with the rear end of the upper surface of the key. More specifically, in the case where the hammer pivotally moves upward in accordance with depression of the key, the point of contact between the rear end of the upper surface of the key and the head of the capstan screw, i.e. the point of action of the key on the hammer not only moves upward, but also shifts from the front half of the lower surface of the head of the capstan screw to the rear half of the same. As a consequence, as the key is depressed, a distance between the hammer fulcrum shaft that pivotally supports the hammer and the above-mentioned point of action is progressively reduced. In this case, load applied from the hammer to the key progressively increases. Particularly in a case where soft key striking in which a key is slowly depressed is performed during musical performance, an increase in load immediately before termination of the key depression can cause the player to feel the key heavy.

In an electronic piano having a keyframe front of the type disclosed in Japanese Patent No. 5797074, the keyframe front can thermally expand or contract e.g. due to changes in the temperature of an environment where the electronic piano is installed, which causes expansion or contraction of the keyframe front in the longitudinal direction. In general, the linear expansion coefficient of a synthetic resin forming the keyframe front molded article is larger than that of a metal forming the front rail, and therefore the keyframe front expands or contracts more than the front rail. In this case, a tensile force and a compressive force in the longitudinal direction acts on two keyframe front molded articles connected to each other at the connecting portions of the respective ends of these, and when these forces repeatedly act, bonding between the connecting portions of the respective keyframe front molded articles connected to each other can be lost.

When the bonding between the connecting portions of the respective keyframe front molded articles connected to each other is lost as mentioned above, the amplitude of expansion or contraction in the longitudinal direction of each of the keyframe front molded articles becomes even larger. Particularly when each of the keyframe front molded articles contracts, spacing between the adjacent front rail pins respectively erected on the two keyframe front molded articles becomes larger than spacing between the other front rail pins. As a consequence, a gap between each adjacent two of the keys engaged with the front rail pins is made larger, which causes variation in gaps between the keys on the keyboard of the electronic piano.

Further, when bonding the two keyframe front molded articles to each other, the adhesive is injected into the gap between the body part of the left keyframe front molded article and the left connecting portion of the right keyframe front molded article, as described above, so as to cause the adhesive to flow into each of the grooves on the left connecting portion. However, it is difficult to cause the adhesive to flow into each of the grooves, and when an inflow of the adhesive is insufficient, the bonding between the connecting portions of the respective two keyframe front molded articles cannot be sufficiently maintained over a long term. Therefore, the conventional keyframe front described above leaves room for improvement.

SUMMARY OF THE INVENTION

It is a first object of the present invention to provide a keyboard device for an electronic keyboard instrument, which is capable of suppressing the bouncing of a hammer on the point of returning, after key depression of an associated key, to its original position where it was before the key depression, consequently causing the key to quickly return to its original position, thereby enabling a player to enjoy excellent playability of the electronic keyboard instrument.

It is a second object of the present invention to provide a keyboard device for an electronic keyboard instrument, which is capable of suppressing an increase in load acting on a key from a hammer, during key depression, to thereby enable the player to enjoy excellent playability of the electronic musical instrument without causing the player to feel the key heavy even when the key is softly depressed for musical performance.

It is a third object of the present invention to provide a keyframe front for a keyboard instrument, which makes it possible to maintain solid connection between keyframe front molded articles over a long term to thereby prevent occurrence of variation in gaps between keys on a keyboard.

To attain the above first object, in a first aspect of the present invention, there is provided a keyboard device for an electronic keyboard instrument, comprising a key extending in a front-rear direction and configured to be swingable about a key fulcrum located at about a center of the key in a longitudinal direction thereof, a hammer extending in the front-rear direction and configured to be pivotally movable in a vertical direction between an initial position and a pivotally-moved position about a hammer fulcrum provided at about a rear end of the key, the hammer being placed on the key via a first contact portion brought into contact with a rear end of an upper surface of the key from above, for being pivotally moved in accordance with swinging of the key, and a hammer bounce-suppressing member provided on one of the upper surface of the key and a lower surface of the hammer at a predetermined position forward of the first contact portion and configured to suppress bouncing of the hammer by being brought into contact with the other of the upper surface of the key and the lower surface of the hammer when the hammer returns from the pivotally-moved position to the initial position in accordance with release of the key depressed.

With the construction of the first aspect of the present invention, the key extending in the front-rear direction is configured to be swingable about the key fulcrum located at about the center of the key in the longitudinal direction, and the hammer extending in the front-rear direction is configured to be pivotally movable in the vertical direction about the hammer fulcrum provided at about the rear end of the key between the initial position which is a position before key depression and the pivotally-moved position which is a position after key depression. Further, the hammer is placed on the key via the first contact portion brought into contact with the rear end of the upper surface of the key from above, for being pivotally moved in accordance with swinging of the key. Further, the hammer bounce-suppressing member is provided on one of the upper surface of the key and the lower surface of the hammer at a predetermined location forward of the first contact portion.

When the front end of a key is pushed down in a key-released state, the key swings about the key fulcrum, so that the rear end of the key moves upward. In accordance with this motion of the key, the hammer in its initial position is pushed up via the first contact portion to pivotally move upward about the hammer fulcrum to a pivotally-moved position above the initial position. Then, when the finger is released from the key being depressed, the hammer pivotally moves downward about the hammer fulcrum and returns to its initial position. In this case, one of the upper surface of the key and the lower surface of the hammer comes into abutment with the hammer bounce-suppressing member provided on the other of the upper surface of the key and the lower surface of the hammer, whereby the bouncing of the hammer is suppressed. The bouncing of the hammer on the point of returning to the initial position after key depression can be thus suppressed, which enables the key to return in a shorter time to its original position where it was before key depression. As a consequence, it becomes possible for the player to play quickly and enjoy excellent playability of the electronic musical instrument.

Preferably, the hammer includes a second contact portion provided immediately forward of the first contact portion, and the hammer bounce-suppressing member is provided on the rear end of the upper surface of the key, and the second contact portion is in abutment with the hammer bounce-suppressing member from above when the hammer is in the initial position.

With the construction of this preferred embodiment, the hammer is provided with the second contact portion, and the hammer bounce-suppressing member is provided on the rear end of the upper surface of the key. Therefore, after release of the key being depressed, the second contact portion of the hammer is brought into abutment with the hammer bounce-suppressing member from above before the hammer returns to the initial position. This makes it possible to stably and effectively suppress the bouncing of the hammer on the point of returning to its initial position. Further, since the second contact portion of the hammer, which is brought into abutment with the hammer bounce-suppressing member, is provided immediately forward of the first contact portion which is in contact with the key, it is possible not only to bring the second contact portion into abutment with the hammer bounce-suppressing member in a relatively shorter time before the hammer returns to its initial position than in a case where the second contact portion is provided on the front end of the lower surface of the hammer, but also to reduce impact on the hammer bounce-suppressing member. Consequently, it is possible to obtain an effect of suppressing the bouncing of the hammer within a relatively wide range of pivotal motion when the hammer returns to its original position as well as to use the hammer bounce-suppressing member over a long term.

Preferably, the hammer bounce-suppressing member is made of urethane foam having a predetermined resilience.

With the construction of this preferred embodiment of the present invention, since the hammer bounce-suppressing member is made of urethane foam having a relatively low resilience, it is possible to effectively suppress the bouncing of the hammer on the point of returning to the initial position. Further, as the urethane foam, it is possible to adopt soft urethane foam which is not only low in resilience, but also lightweight and excellent in impact absorption and cushioning properties.

To attain the above second object, in a second aspect of the present invention, there is provided a keyboard device for an electronic keyboard instrument, including a key extending in a front-rear direction and configured to be swingable about a key fulcrum located at about a center of the key in a longitudinal direction thereof, and a hammer extending in the front-rear direction and having a rear end thereof supported such that the hammer is pivotally movable in a vertical direction about a hammer fulcrum provided at about a rear end of the key, the hammer being placed on a rear end of an upper surface of the key, for being pivotally moved in accordance with swinging of the key, wherein the hammer comprises a hammer body extending in the front-rear direction and having a rear end thereof pivotally movable about the hammer fulcrum, and a key contact portion provided such that the key contact portion protrudes downward from a rear end of a lower surface of the hammer body and configured to be brought into contact with the rear end of the upper surface of the key from above, wherein the key contact portion is configured such that during pivotal motion of the hammer, a distance between a contact portion thereof in contact with the upper surface of the key and the hammer fulcrum is approximately constant.

With the construction of the second aspect of the present invention, the key extending in the front-rear direction is configured to be swingable about the key fulcrum located at about the center of the key in the longitudinal direction, and the hammer extending in the front-rear direction has its rear end supported such that the hammer can pivotally move in the vertical direction about the hammer fulcrum provided at about the rear end of the key. The hammer has the key contact portion protruding downward from the rear end of the lower surface of the hammer body extending in the front-rear direction and configured to be brought into contact with the rear end of the upper surface of the key from above. This key contact portion is configured such that during pivotal motion of the hammer, the distance between the contact portion thereof in contact with the upper surface of the key and the hammer fulcrum is approximately constant. Thus, differently from the conventional keyboard device in which the hammer is placed on the rear end of the upper surface of the key via the capstan screw, the keyboard device according to the second aspect makes it possible to suppress an increase in load applied to the key from the hammer when the hammer is pivotally moved in accordance with key depression. As a consequence, even when performing soft key depression in which the key is slowly depressed for musical performance, the player does not feel the key heavy, and therefore it is possible to enjoy excellent playability of the electronic musical instrument.

Preferably, the key contact portion has a bottom formed in an approximately arcuate shape in side view, and the bottom comprises a front bottom portion that forms a front half of the bottom and can be brought into contact with the key and a rear bottom portion that forms a rear half of the bottom and cannot be brought into contact with the key.

With the construction of this preferred embodiment, the bottom of the key contact portion, which is formed in an approximately arcuate shape in side view, has the front bottom portion forming the front half of the bottom, which can be brought into contact with the key, and the rear bottom portion forming the rear half of the bottom, which cannot be brought into contact with the key. Consequently, when the hammer moves upward in accordance with depression of the key, only the front bottom portion of the front half of the key contact portion of the hammer comes into contact with the rear end of the upper surface of the key only, so that differently from the conventional keyboard device in which the rear half of the head of the capstan screw comes into contact with the rear end of the upper surface of the key, the keyboard device of the present preferred embodiment makes it possible to suppress reduction of the distance between the contact portion of the key contact portion, which is in contact with the upper surface of the key, and the hammer fulcrum, with relative ease, whereby it is possible to easily achieve the action and effects described above.

More preferably, the keyboard device further comprises a hammer cushion provided immediately forward of the key contact portion on the rear end of the upper surface of the key and configured such that in a key-released state, a predetermined portion of the lower surface of the hammer is in abutment with the hammer cushion from above, and the front bottom portion is formed in an arcuate shape which has a predetermined curvature radius so as to maintain the hammer in the key-released state in substantially the same posture before and after the hammer cushion undergoes aging deformation.

With the construction of this preferred embodiment, the hammer cushion is provided on the rear end of the upper surface of the key at a location immediately forward of the key contact portion, and in the key-released state, the predetermined portion of the lower surface of the hammer is in abutment with the hammer cushion from above. This brings the hammer into abutment with the hammer cushion, on the point of returning to the initial position after release of the depressed key, whereby it is possible to suppress impact on the hammer on the point of returning to its original position and the bouncing of the hammer.

Further, the long-term use of the electronic piano sometimes causes the hammer cushion to be progressively crushed and undergo aging deformation due to being repeatedly pressed by the hammer from above, resulting in a lowered level of the upper surface of the hammer cushion. In this case, if the front bottom portion of the key contact portion is formed in an arcuate shape which has a relatively small curvature radius, in the key-released state, the hammer is brought into a posture inclined downward and forward compared with a correct posture before occurrence of the aging deformation, which can make e.g. musical tone-generating timing and sound volume in the electronic keyboard instrument different from correct timing and correct sound volume. To avoid this, the front bottom portion of the key contact portion is formed in an arcuate shape, which has a relatively large predetermined curvature radius, so as to maintain the hammer in the key-released state in substantially the same posture before and after occurrence of the aging deformation of the hammer cushion. This makes it possible to maintain the hammer in its correct posture in the key-released state over a long term even when the hammer cushion undergoes aging deformation, to thereby prevent occurrence of the above-described inconvenience.

Preferably, the key contact portion comprises a contact protrusion integrally formed with the hammer body and having a protruding shape protruding downward, and a protrusion cover having the front bottom portion and the rear bottom portion and removably mounted on the contact protrusion.

With the construction of this preferred embodiment, by mounting the protrusion cover having the front bottom portion and the rear bottom portion on the contact protrusion integrally formed with the hammer body, it is possible to form the key contact portion having the front bottom portion and the rear bottom portion with relative ease. Further, the protrusion cover is removable from the contact protrusion of the hammer body, so that e.g. in the case of changing the design of the front bottom portion and the rear bottom portion, it is possible to easily change the design by changing the protrusion cover alone, without changing the whole hammer.

To attain the above third object, in a thirst aspect of the present invention, there is provided a keyframe front for a keyboard instrument, which is formed to extend in a left-right direction, by interconnecting ends of a plurality of keyframe front molded articles each made of a synthetic resin and extending in the left-right direction, and on which plurality of front rail pins for engagement with front ends of a plurality of keys, respectively, are erected in a state arranged side by side in the left-right direction, wherein one keyframe front molded article of each adjacent two of the keyframe front molded articles has an end thereof provided with a connecting engagement protrusion protruding toward the other keyframe front molded article adjacent thereto and having a predetermined shape in plan view, and the other keyframe front molded article has an end thereof provided with a connecting engagement recess which is formed in a recessed shape fittable with the shape in plan view of the connecting engagement protrusion and engages the connecting engagement protrusion in a state immovable relative to the connecting engagement protrusion in the left-right direction.

With the construction of the third aspect of the present invention, by connecting the ends of a plurality of keyframe front molded articles each made of a synthetic resin and extending in the left-right direction to each other, a keyframe front is formed which extends in the left-right direction and on which a plurality of front rail pins are erected in a state arranged side by side in the left-right direction. Further, an end of one of each adjacent two of the keyframe front molded articles is formed with the connecting engagement protrusion having a predetermined shape in plan view, and an end of the other keyframe front molded article is formed with the connecting engagement recess which is engaged with the connecting engagement protrusion. This connecting engagement recess is formed in a recessed shape fittable with the shape in plan view of the connecting engagement protrusion and engages the connecting engagement protrusion in a state immovable relative to the connecting engagement protrusion in the left-right direction. By thus fitting the connecting engagement protrusion and the connecting engagement recess with each other into a state immovably engaged with each other, it is possible to connect the adjacent two keyframe front molded articles to each other by their own mechanical connection, so that even when the keyframe front molded articles expand or contract due to thermal expansion or contraction, solid connection between the ends of the respective two keyframe front molded articles can be maintained. As described above, according to the present invention, it is possible to maintain solid connection between each adjacent two of the keyframe front molded articles over a long term to thereby prevent occurrence of variation in gap between the keys on the keyboard.

Preferably, the connecting engagement protrusion includes a first protrusion having a predetermined width in a front-rear direction and extending over a predetermined length in the left-right direction, and a second protrusion provided on a tip end of the first protrusion and protruding over a predetermined length at least in one of a forward direction and a rearward direction.

With the construction of this preferred embodiment, the connecting engagement protrusion including the first protrusion and the second protrusion is formed in an L shape or a T shape in plan view, and engages the connecting engagement recess in a state fitted to each other, whereby it is possible to relatively easily and stably connect adjacent keyframe front molded articles to each other in a state immovable relative to each other in the left-right direction.

Preferably, the keyframe front comprises fixing means for fixing the connecting engagement protrusion and the connecting engagement recess to each other in a state held in intimate contact with each other in a vertical direction.

With the construction of this preferred embodiment, the connecting engagement protrusion and the connecting engagement recess are not only engaged with each other, but also secured to each other in a state held in intimate contact with each other in the vertical direction by the fixing means, and therefore the adjacent keyframe front molded articles can be more solidly connected to each other.

More preferably, the fixing means includes an adhesive for bonding the connecting engagement protrusion and the connecting engagement recess to each other in the vertical direction.

With the construction of this preferred embodiment, by using an adhesive as fixing means, it is possible to secure the connecting engagement protrusion and the connecting engagement recess to each other in a state bonded in the vertical direction.

Further preferably, one of the connecting engagement protrusion and the connecting engagement recess has at least one adhesive injection hole formed therethrough in the vertical direction and has a plurality of grooves formed on a flat surface thereof in contact with the other of the connecting engagement protrusion and the connecting engagement recess such that the plurality of grooves are continuous with the adhesive injection hole and extend radially therefrom.

With the construction of this preferred embodiment, one of the connecting engagement protrusion and the connecting engagement recess has at least one adhesive injection hole formed therethrough in the vertical direction and a plurality of grooves formed thereon which are continuous with the adhesive injection hole and extend radially therefrom. When bonding the connecting engagement protrusion and the connecting engagement recess by an adhesive, the two are fitted with each other and superposed one upon the other, and the adhesive is injected into the adhesive injection hole from outside, whereby the adhesive flows into the grooves radially extending from the adhesive injection hole. This makes it possible to stably supply the adhesive in a relatively wide range between the connecting engagement protrusion and the connecting engagement recess superposed one upon the other in a well-balanced manner as a whole, which makes it possible to solidly bond the connecting engagement protrusion and the connecting engagement recess to each other.

Further preferably, the fixing means further includes a fixing screw for screwing the connecting engagement protrusion and the connecting engagement recess to each other in a state fixed in the vertical direction by swaging.

With the construction of this preferred embodiment, the connecting engagement protrusion and the connecting engagement recess bonded to each other by the adhesive are screwed to each other in a state fixed in the vertical direction by swaging, and therefore it is possible not only to more solidly bond the connecting engagement protrusion and the connecting engagement recess, but also to stably maintain the state over a long term.

Furthermore preferably, the connecting engagement protrusion has a screw protrusion formed in a shape protruding in the vertical direction and having a screw hole formed inside for having the fixing screw screwed therein, and the connecting engagement recess has an insertion hole formed therethrough in the vertical direction for having the screw protrusion inserted therein.

With the construction of this preferred embodiment, while the connecting engagement protrusion is formed with the screw protrusion, the connecting engagement recess is formed with the insertion hole, so that work for assembling the keyframe front molded articles can be carried out with relative ease by fitting the connecting engagement protrusion in the connecting engagement recess while inserting the screw protrusion into the insertion hole. Further, by inserting the screw protrusion into the insertion hole in addition to fitting between the connecting engagement protrusion and the connecting engagement recess, it is possible to more solidly connect the keyframe front molded articles in a state immovable relative to each other in the left-right direction.

The above and other objects, features, and advantages of the present invention will become more apparent from the following detailed description taken in conjunction with the accompanying drawings.

BRIEF DESCRIPTION OF THE DRAWINGS

FIGS. 9A to 9C are views useful in explaining the hammer and a protrusion cover mounted on a contact protrusion of the hammer, in which FIG. 9A is a side view of the hammer, FIG. 9B is a longitudinal cross-sectional view of a portion of the hammer including the contact protrusion and the protrusion cover as essential parts, and FIG. 9C is a perspective view of the protrusion cover.

FIGS. 10A and 10B are enlarged views useful in explaining a contact position of the hammer on the key, in which FIG. 10A shows a key-released state, and FIG. 10B shows a key-depressed state.

DETAILED DESCRIPTION OF PREFERRED EMBODIMENTS

Figure 1A:
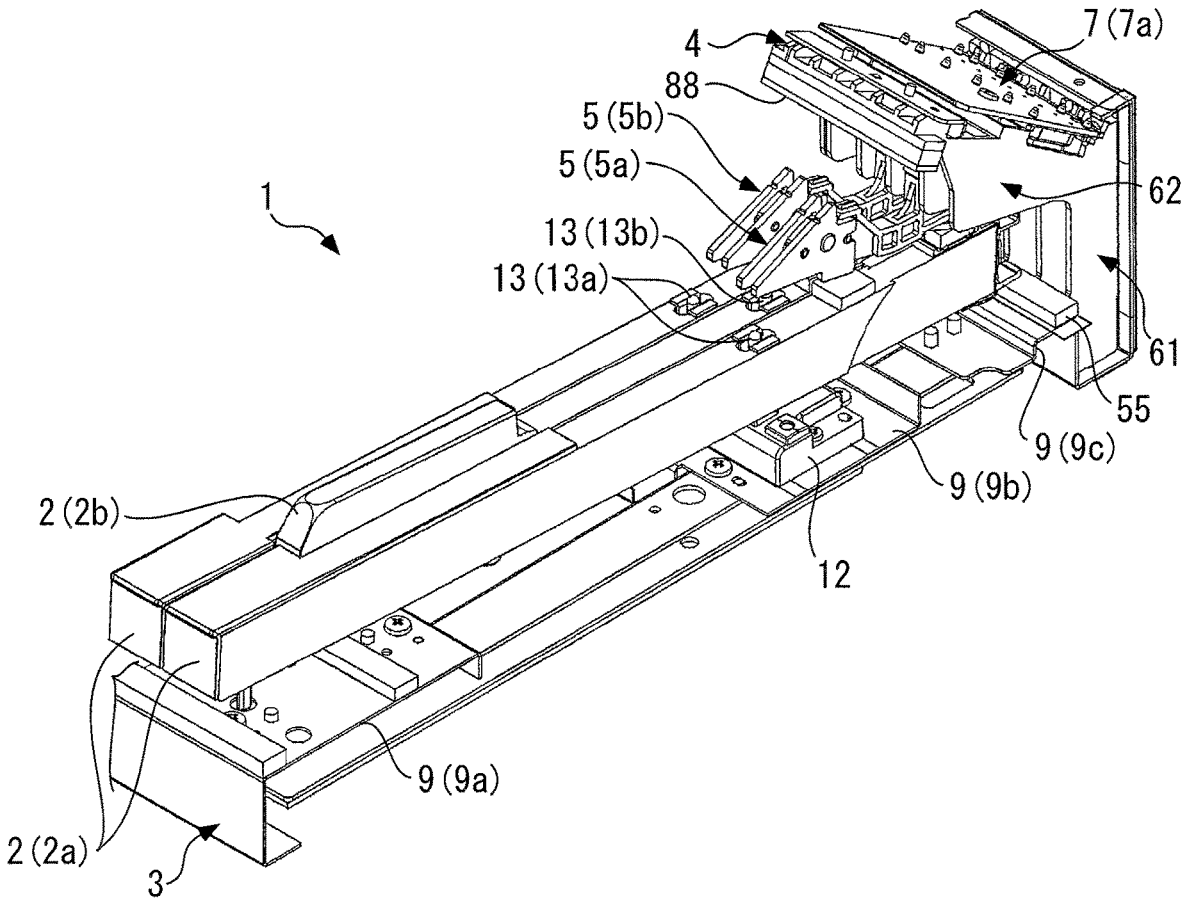
FIG. 1A is a perspective view of a portion of a keyboard device of an electronic piano to which is applied a keyboard device according to an embodiment of the present invention.
Figure 1B:
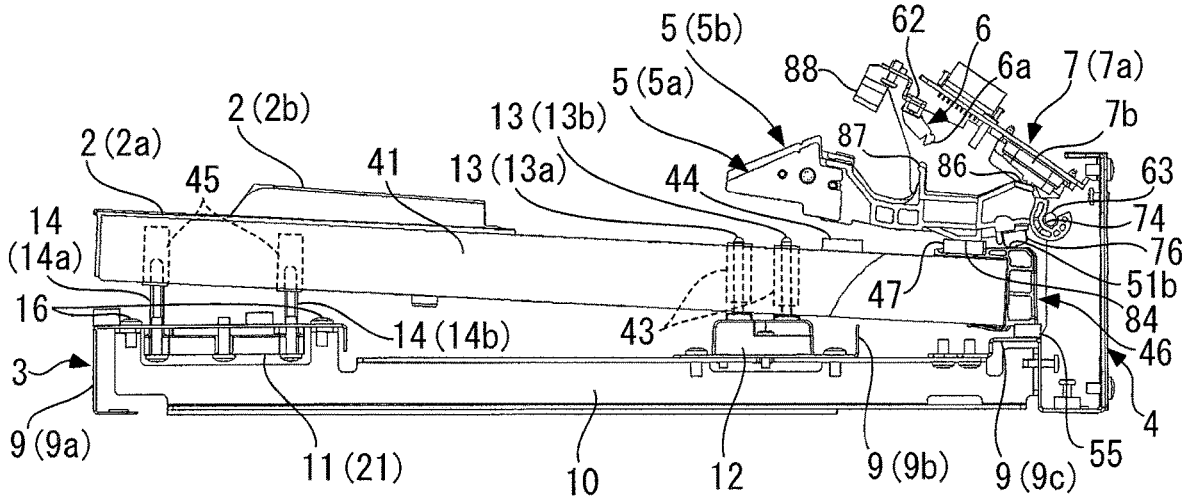
FIG. 1B is a side view of the portion of the keyboard device shown in FIG. 1A.

The present invention will now be described in detail with reference to the drawings showing preferred embodiments thereof. FIGS. 1A and 1B partially show a keyboard device for an electronic piano in a key-released state, to which are applied a keyboard device and a keyframe front for a keyboard instrument, according to the present invention. As shown in FIGS. 1A and 1B, the keyboard device, denoted by reference numeral 1, includes a plurality of keys 2 (only two white keys 2*a* and one black key 2*b* are shown in FIG. 1A) arranged side by side in a left-right direction of the electronic piano, a keyboard chassis 3 supporting the keys 2, a hammer support 4 connected to the rear end of the keyboard chassis 3, a plurality of hammers 5 (only one white-key hammer 5*a* and one black-key hammer 5*b* are shown in FIG. 1A) provided for the respective keys 2 and each configured to be pivotally moved in accordance with key depression of an associated one of the keys 2, a plurality of let-off members 6 (only one of which is shown in FIG. 1B) provided for the respective hammers 5 and each configured to add let-off feeling during key depression of an associated one of the keys 2, and a key switch 7 for detecting key depression information on the keys 2.

The keyboard chassis 3 is formed by assembling, in parallel crosses, three support rails 9, i.e. a front rail 9*a*, a middle rail 9*b*, and a rear rail 9*c* each extending in the left-right direction and arranged with predetermined distances therebetween in the front-rear direction, and a plurality of reinforcement ribs 10 each extending in the front-rear direction. The keyboard chassis 3 is secured to a keybed, not shown. The support rails 9 and the ribs 10 are made of metal plates formed into respective predetermined shapes by stamping and bending using a press.

A keyframe front 11 and a keyframe center 12 are secured to the lower surface of the front rail 9*a* and the upper surface of the middle rail 9*b*, respectively. The keyframe front 11 and the keyframe center 12 are thick plate-like members made of a synthetic resin and extend in the left-right direction along the whole length of the front rail 9*a* and that of the middle rail 9*b*, respectively. On the keyframe center 12, there are erected a plurality of balance rail pins 13 (key fulcrums: two white-key balance rail pins 13*a* and one black-key balance rail pin 13*b* are shown in FIG. 1A) at front and rear locations corresponding to the white keys 2*a* and the black keys 2*b*, respectively, in a state arranged in the left-right direction. On the other hand, on the keyframe front 11, there are erected a plurality of front rail pins 14 in a state arranged in the left-right direction.

Figure 2A:
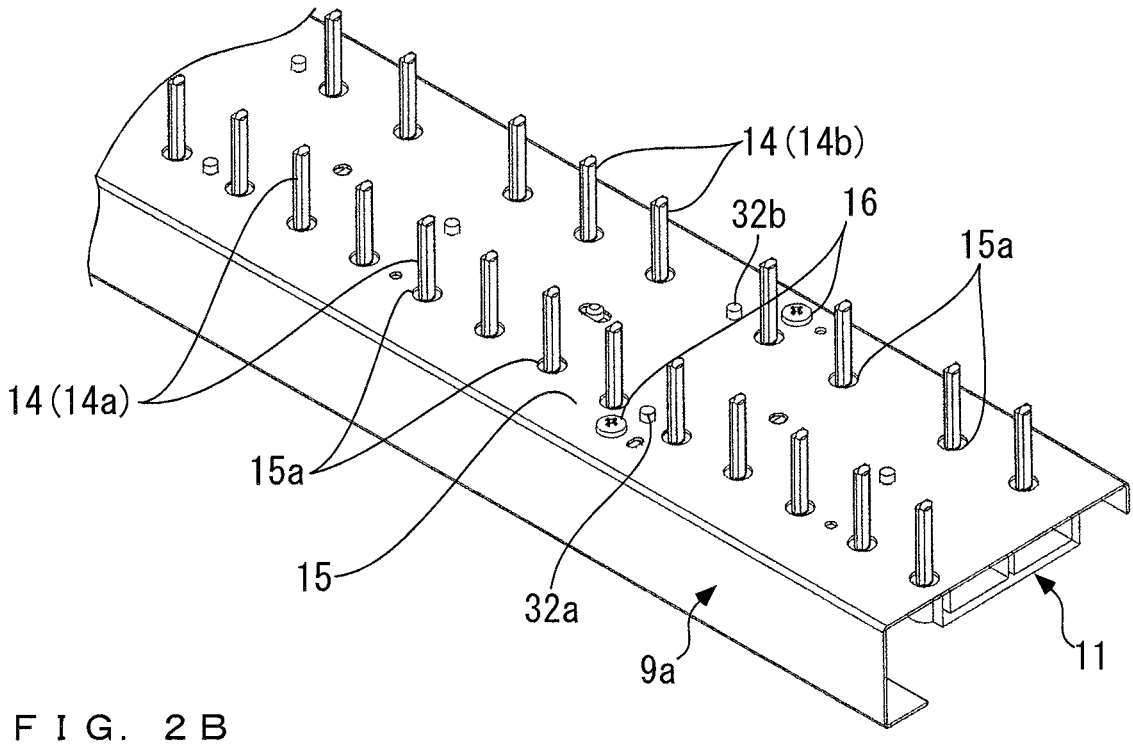
FIG. 2A is a perspective view partially showing a front rail and a keyframe front, on which front rail pins are erected, in a state in which the keyframe front is attached to the front rail.
Figure 2B:
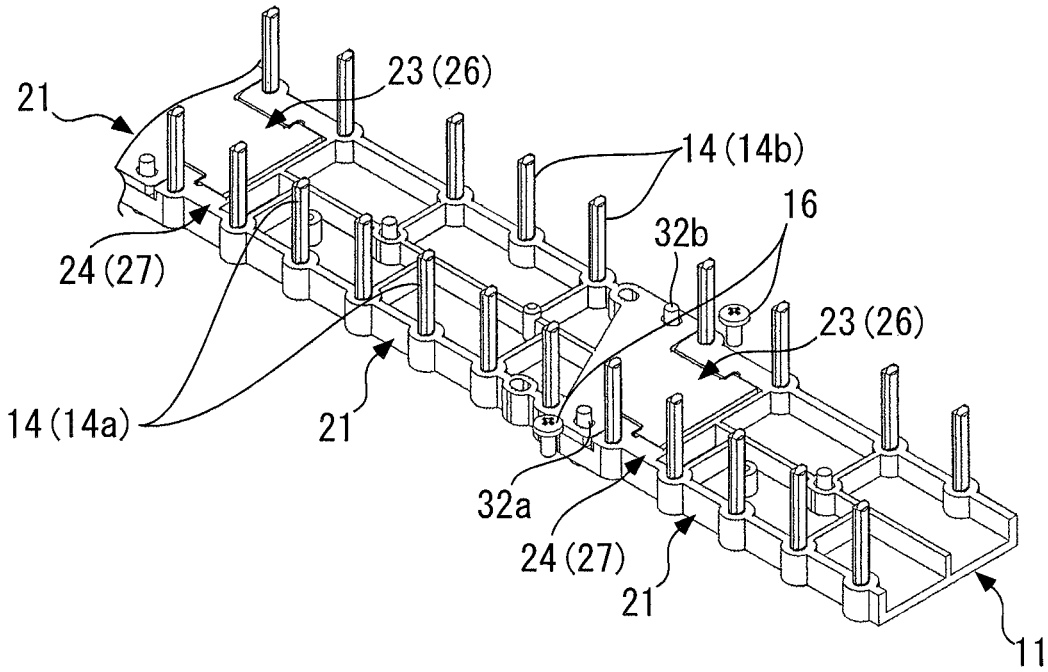
FIG. 2B is a perspective view partially showing the keyframe front in a state in which the front rail is omitted from FIG. 2A.

FIGS. 2A and 2B partially show the front rail 9*a* and the keyframe front 11, on which the front rail pins 14 are erected. FIG. 2A shows a state in which the keyframe front 11 is mounted to the front rail 9*a*, and FIG. 2B shows a state in which the front rail 9*a* is omitted from FIG. 2A. As shown in FIG. 2A, the front rail 9*a* has a top board 15 formed with a plurality of pin openings 15*a* each having a larger diameter than the outer diameter of the front rail pin 14 at locations corresponding to the respective front rail pins 14, and the front rail pins 14 project upward through the respective pin openings 15*a*. Note that two screws 16 and 16 appearing in FIGS. 2A and 2B are for securing the front portion of the rib 10 (see FIG. 1B) of the keyboard chassis 3 to the lower surface of the top board 15 of the front rail 9*a*.

The keyframe front 11 is formed by connecting a plurality of keyframe front molded articles 21 each extending in the left-right direction to each other in the left-right direction. FIGS. 3A and 3B and FIGS. 4A and 4B show two keyframe front molded articles 21 and 21 that form a portion of the keyframe front 11. Each of the keyframe front molded articles 21 is made of a predetermined synthetic resin (e.g. an ABS resin or polystyrene) and is comprised of a body part 22 formed with a plurality of pin holes 22*a* and 22*b* for fixing the respective front rail pins 14, and a right connecting portion 23 and a left connecting portion 24 protruding from the respective left and right ends of the body part 22, which are used to connect itself to respective adjacent keyframe front molded articles 21 and 21.

The front end of the body part 22 is formed with seven pin holes 22*a* at predetermined spaced intervals in the left-right direction. Each of the pin holes 22*a* is configured such that a front rail pin 14*a* (see FIG. 1B, and FIGS. 2A and 2B) for the associated white key 2*a* can be erected with the lower end thereof press-fitted in the pin hole 22*a*. On the other hand, the rear end of the body part 22 is formed with five pin holes 22*b* at predetermined spaced intervals in the left-right direction. Each of the pin holes 22*b* is configured such that a front rail pin 14*b* (see FIG. 1B, and FIGS. 2A and 2B) for the associated black key 2*b* can be erected in the same manner as the front rail pin 14*a* for the white key 2*a*. Note that each of the keyframe front molded articles 21 shown in FIG. 3A to FIG. 4B corresponds to a one-octave section of the keyboard device.

On the other hand, the right connecting portion 23 is formed such that a lower half portion thereof is substantially cut out, and the left connecting portion 24 is formed such that an upper half portion thereof is substantially cut out. Further, the right connecting portion 23 of one of the keyframe front molded articles 21 and the left connecting portion 24 of the other are configured such that they are engaged with each other in a state vertically fitted with each other and immovable relative to each other in the front-rear direction and the left-right direction.

Specifically, the right connecting portion 23 includes a base portion 25 continuous with the right end of the body part 22 and having approximately the same width in the front-rear direction as that of the body part 22, and a connecting engagement protrusion 26 protruding rightward from the base portion 25 and having a lateral T shape in plan view. More specifically, the connecting engagement protrusion 26 is comprised of a reduced-width portion 26*a* (first protrusion) having a width smaller than that of the base portion 25 in the front-rear direction and protruding rightward from the base portion 25 over a predetermined length, and an increased-width portion 26*b* (second protrusion) continuous with the reduced-width portion 26*a* and protruding rightward from the same over a predetermined length, with a width larger than that of the reduced-width portion 26*a* and smaller than that of the base portion 25 in the front-rear direction.

Figure 3A:
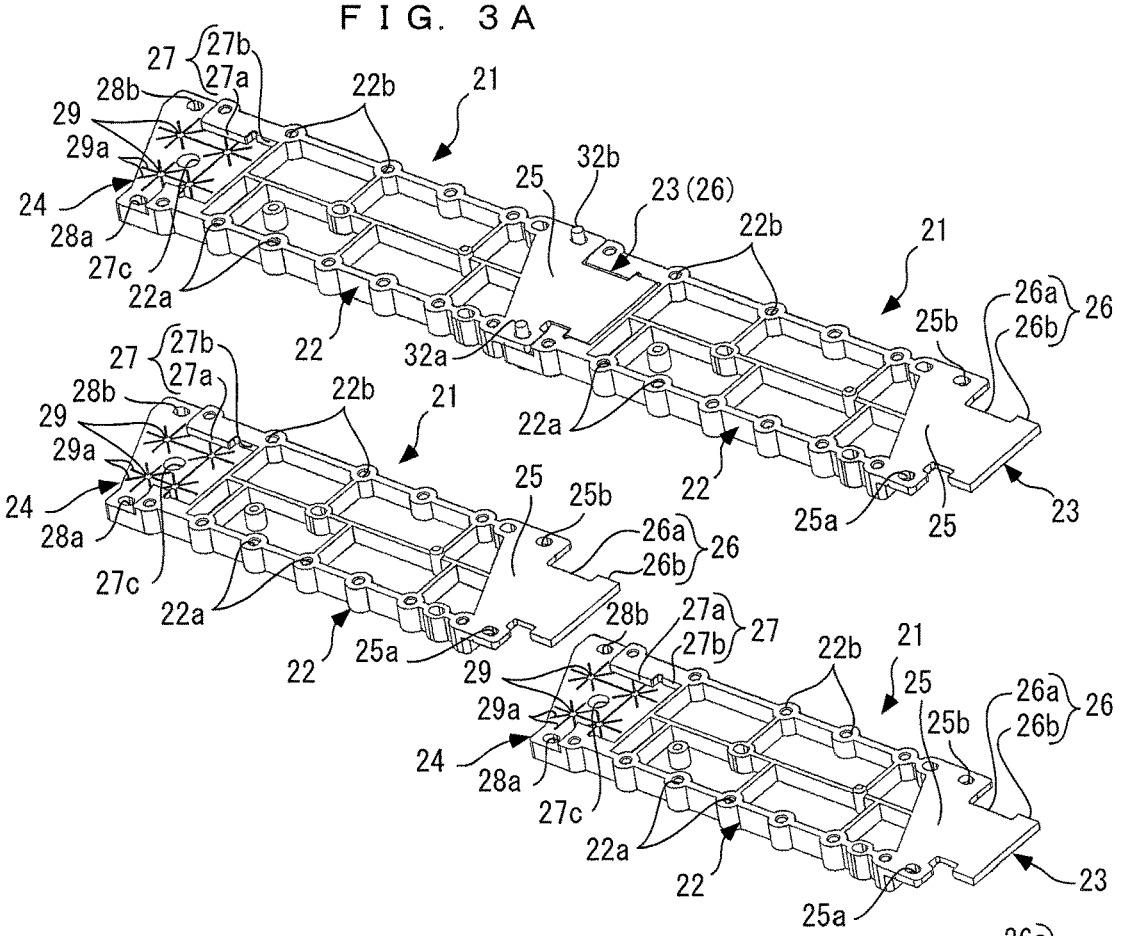
FIG. 3A is a perspective view of two keyframe front molded articles connected to each other, as viewed obliquely from above, in respective states before and after connection.
Figure 3B:
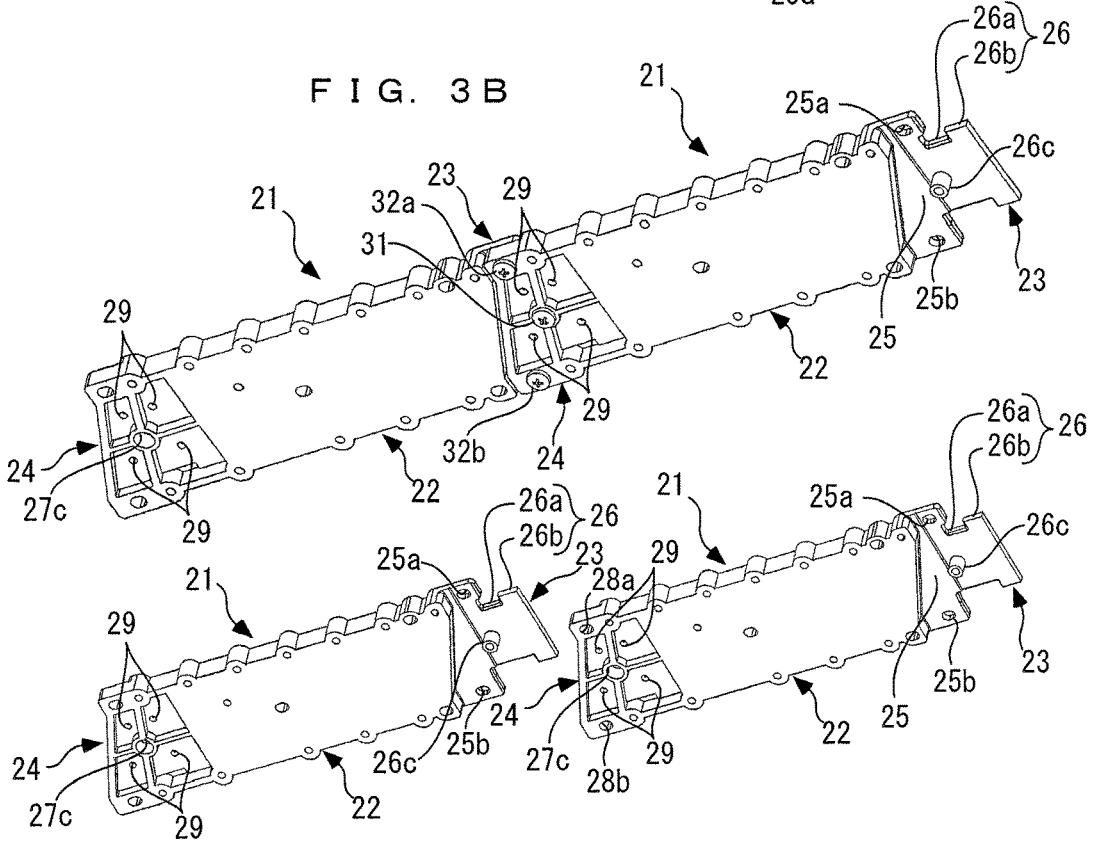
FIG. 3B is a perspective view of the two keyframe front molded articles, as viewed obliquely from below, in the respective states before and after connection.
Figure 4A:
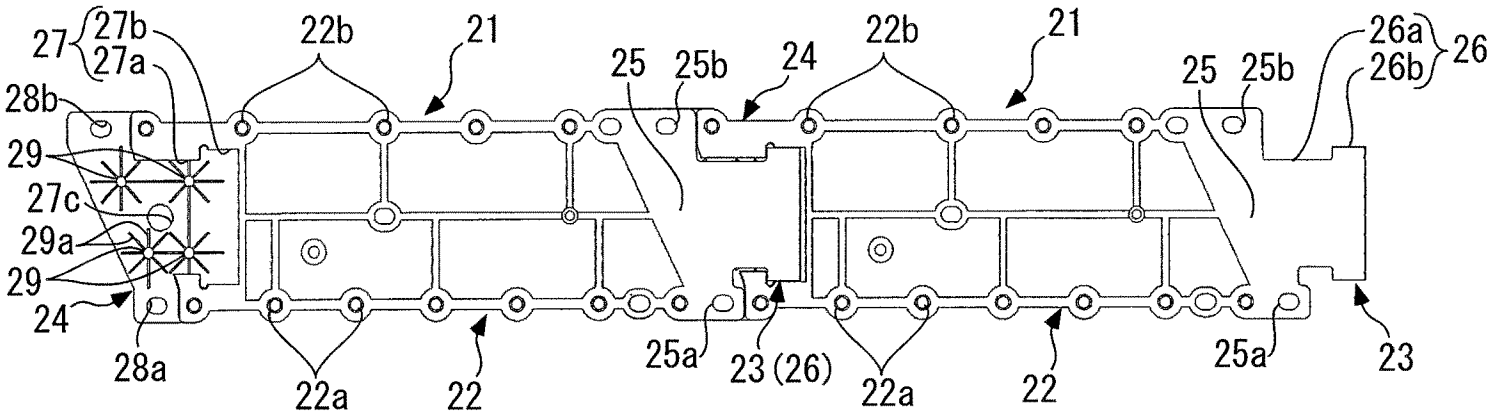
FIG. 4A is a plan view of the two keyframe front molded articles in the connected state.
Figure 4B:
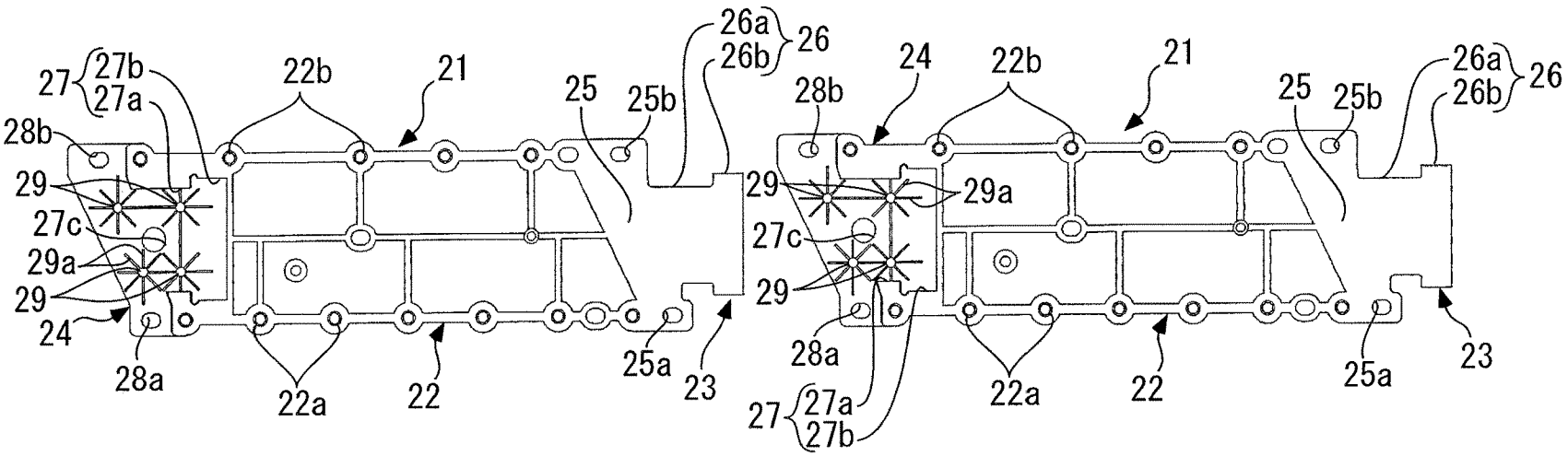
FIG. 4B is a plan view of the two keyframe front molded articles shown in FIG. 4A in the state before connection.

The base portion 25 of the right connecting portion 23 has a front end and a rear end formed with slots 25*a* and 25*b*, respectively, each extending therethrough in the vertical direction and slightly elongated in the left-right direction. Further, as shown in FIG. 3B, at a predetermined location on the lower surface of the connecting engagement protrusion 26, there is formed a cylindrical screw protrusion 26*c* protruding downward over a predetermined length and having a female screw formed on an inner peripheral surface thereof.

On the other hand, the left connecting portion 24 has a connecting engagement recess 27 continuous with the left end of the body part 22 and formed such that it has approximately the same shape in plan view as the shape formed by the above-described base portion 25 and the connecting engagement protrusion 26 of the right connecting portion 23 and is lower in height than the base portion 25 and the connecting engagement protrusion 26 by one step which corresponds to the thickness of the base portion 25 and the connecting engagement protrusion 26. More specifically, the connecting engagement recess 27 includes a reduced-width portion 27*a* and an increased-width portion 27*b* which correspond, respectively, to the reduced-width portion 26*a* and the increased-width portion 26*b* of the connecting engagement protrusion 26 and has respective inner dimensions approximately equal to the outer dimensions of the reduced-width portion 26*a* and the increased-width portion 26*b*. Further, in a central portion of the connecting engagement recess 27, there is formed an insertion hole 27*c* extending therethrough in the vertical direction, for having the screw protrusion 26*c* inserted therein when the keyframe molded articles 21 and 21 are connected to each other. Furthermore, the left front end and left rear end of the connecting engagement recess 27 are formed with slots 28*a* and 28*b*, respectively, each extending therethrough in the vertical direction and slightly elongated in the left-right direction.

In addition, the left connecting portion 24 is formed with a plurality of adhesive injection holes 29 (four holes in the present embodiment) for use when an adhesive is injected from the lower surface side of the left connecting portion 24 toward the upper surface side of the same. Specifically, the adhesive injection holes 29 each extending through the connecting engagement recess 27 in the vertical direction are formed around the insertion hole 27*c* of the connecting engagement recess 27. Further, on the upper surface of the connecting engagement recess 27, there are formed a plurality of (eight, in the present embodiment) grooves 29*a* continuous with each of the adhesive injection holes 29 and radially extending therefrom.

The keyframe front molded articles 21 each constructed as above form the keyframe front 11 extending in the left-right direction by being connected to each other as follows: First, in two keyframe front molded articles 21 and 21 to be connected to each other, the connecting engagement protrusion 26 and the screw protrusion 26*c* of one of the keyframe front molded articles 21 are fitted, respectively, in the connecting engagement recess 27 and the insertion hole 27*c* of the other keyframe front molded article 21 from above. Then, a swaging screw 31 (fixing screw) is screwed into the screw protrusion 26*c* fitted in the insertion hole 27*c* (see FIG. 3B). Thereafter, a predetermined adhesive is injected into each of the four adhesive injection holes 29. As a consequence, the adhesive injected into each of the adhesive injection holes 29 flows into the radial grooves 29*a* continuous with the adhesive injection hole 29, whereby the connecting engagement protrusion 26 of the one keyframe front molded article 21 and the connecting engagement recess 27 of the other keyframe front molded article 21 are bonded to each other.

The keyframe front 11 formed by interconnecting the plurality of keyframe front molded articles 21 as described above is secured to the front rail 9*a* by inserting mounting screws 32*a* and 32*b*, from below, through the front slots 25*a* and 28*a* and the rear slots 25*b* and 28*b* of the left and right connecting portions 23 and 24 of the respective two keyframe front molded articles 21 and 21 connected to each other and screwing the mounting screws 32*a* and 32*b* into respective screw holes formed in the top board 15 of the front rail 9*a*.

Figure 5A:
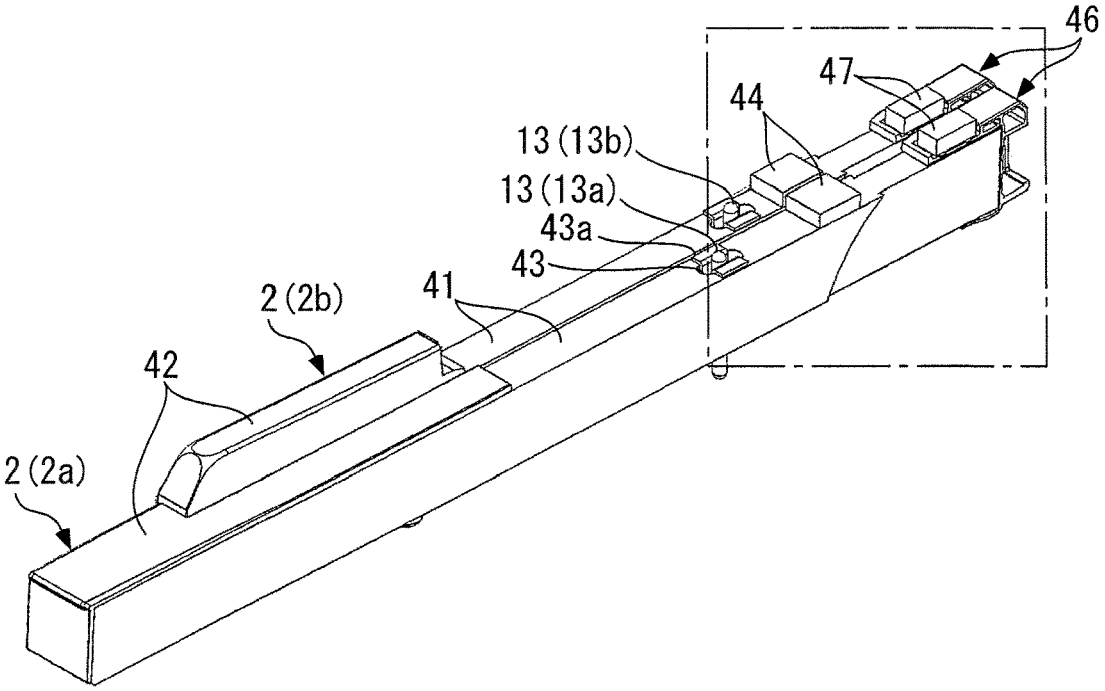
FIG. 5A is a perspective view showing a white key and a black key.

FIG. 5A shows a white key 2*a* and a black key 2*b*. As shown in FIG. 5A, the keys 2 have wooden key bodies 41 each extending in the front-rear direction and having a rectangular shape in transverse cross section and key covers 42 made of a synthetic resin and bonded to the upper surface and the front surface of the respective front half portions of the key bodies 41. At a location at about the center of each key body 41 in the longitudinal direction of the same, there is formed a balance rail pin hole 43, and the key 2 is swingably supported by the balance rail pin 13 erected on the keyframe center 12 via the balance rail pin hole 43.

Each of the balance rail pin holes 43 of the key 2 has a substantially circular hole formed at and near the lower surface of the key body 41 and a whole upper portion thereof continuous with the circular hole formed in a slot-like shape which is elongated in the longitudinal direction of the key body 41. Further, on each of the left and right inner surfaces of the balance rail pin hole 43, there is provided a felt 43*a* so as to hold the key 2 in smooth sliding contact with the balance rail pin 13 during its swinging motion.

A cushion 44 is bonded to the upper surface of the key body 41 at a location rearward of the balance rail pin hole 43. The cushion 44 is provided so as to prevent the front end of the hammer 5 from being brought into direct abutment against the key 2 e.g. during musical performance or maintenance.

Further, the key body 41 has a front rail pin hole 45 opening downward (see FIG. 1B) which is formed at a predetermined location in the front portion thereof, and the front rail pin hole 45 is brought into engagement with the front rail pin 14 erected on the keyframe front 11, whereby the key 2 is prevented from laterally swaying during its swinging motion.

Figure 5B:
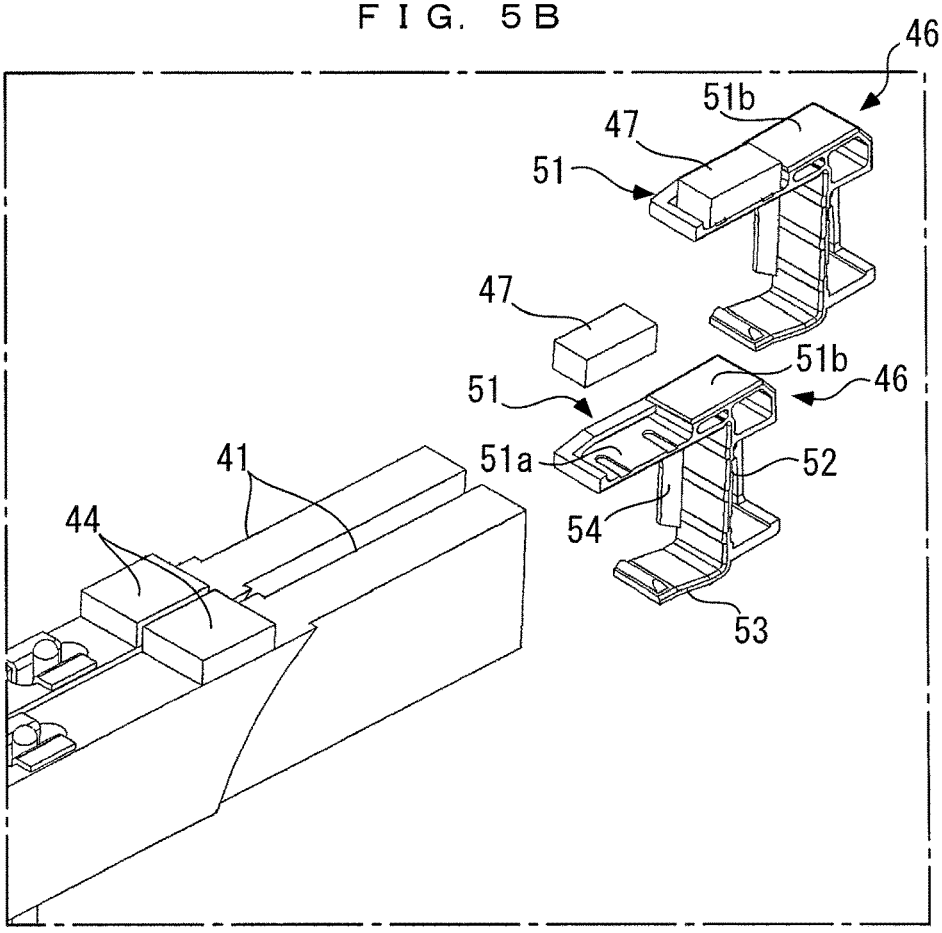
FIG. 5B is an enlarged exploded perspective view of rear ends of the white key and the black key, in a state in which hammer contact height-regulating portions and hammer cushions provided for the white key and the black key, respectively, are disassembled from key bodies.

Furthermore, as shown in FIGS. 5A and 5B, on the rear end of the key body 41 of each of the white key 2*a* and the black key 2*b*, there are mounted a hammer contact height-regulating portion 46 for regulating the contact height of the hammer 5 in the key-released state and a hammer cushion 47 (hammer bounce-suppressing member) with which the hammer 5 is in contact in the key-released state and is brought into abutment on the point of returning to its original position (initial position) after having been pivotally moved in accordance with key depression.

The hammer contact height-regulating portion 46 is formed as a molded article made of a hard synthetic resin (e.g. an ABS resin) and having a predetermined shape. Specifically, the hammer contact height-regulating portion 46 is formed in a C shape in side view by an upper piece 51 extending in the front-rear direction over a predetermined length, a rear piece 52 continuous with the rear portion of the upper piece 51 and extending downward, and a lower piece 53 continuous with the lower end of the rear piece 52 and extending forward over a predetermined length. Further, on the left side of the hammer contact height-regulating portion 46, there is provided a side wall 54 continuous with the upper piece 51 and the rear piece 52.

As shown in 5B, the upper piece 51 is comprised of an upper piece-fixing portion 51*a* that forms the front half of the upper piece 51 and secures the upper piece 51 itself to the rear end of the upper surface of the key body 41, and a hammer-receiving portion 51*b* that forms the rear half of the upper piece 51 and has an upper surface formed flat for receiving a key contact portion 76, described hereinafter, of the hammer 5 in a state supporting the same from below. The upper piece-fixing portion 51*a* is formed to be smaller in thickness than the hammer-receiving portion 51*b*, and a C-shaped bracket, not shown, is hammered down from above, whereby the upper piece 51 is secured to the rear end of the upper surface of the key body 41.

Further, the hammer cushion 47 formed in a block shape is fixed by bonding to the upper piece-fixing portion 51*a* of the upper piece 51. The hammer cushion 47 is made of soft urethane foam having a low resilience. This soft urethane foam is low in rebound resilience, and is also lightweight and excellent in impact absorption and cushioning properties. The hammer cushion 47 is provided for suppressing the bouncing of the hammer 5 on the point of returning, after key release, to its original position where it was before key depression, by contact between a cushion contact portion 84, referred to hereinafter, of the hammer 5 and the hammer cushion 47 itself.

The hammer contact height-regulating portion 46 is mounted to the rear end of the key body 41, in a state in which three surfaces thereof, i.e. the lower surface of the upper piece 51, the front surface of the rear piece 52, and the side wall 54 are held in intimate contact with the respective three surfaces of the key body 41, i.e. the upper surface, the rear end surface, and the left side surface of the rear end of the key body 41, and the lower piece 53 is held in contact with the rear end of the lower surface of the key body 41.

In the key-released state of the key 2 having the hammer contact height-regulating portion 46 mounted thereon, the rear piece 52 of the hammer contact height-regulating portion 46 is placed on a cushion 55 fixed to the rear rail 9*c*, as shown in FIG. 1B. Therefore, the hammer-receiving portions 51*b* of the hammer contact height-regulating portions 46 of all the keys 2 are at the same level in the key-released state.

FIGS. 6A to 6C and FIGS. 7A and 7B show the hammer support 4. As shown in these figures, the hammer support 4 is formed by connecting a plurality of molded articles each made of a synthetic resin and provided e.g. for a one-octave section to each other in the left-right direction. The hammer support 4 extends over the length of all the hammers 5 in the left-right direction and is screwed to the rear rail 9*c* of the keyboard chassis 3. The hammer support 4 is comprised of a hammer supporting portion 61 erected in the vicinity of the rear rail 9*c* and a switch-mounting portion 62 extending forward and obliquely upward from the upper end of the hammer supporting portion 61. In the upper end of the hammer supporting portion 61, there are provided hammer fulcrum shafts 63 (hammer fulcrums) for pivotally supporting the respective hammers 5.

Figure 6A:
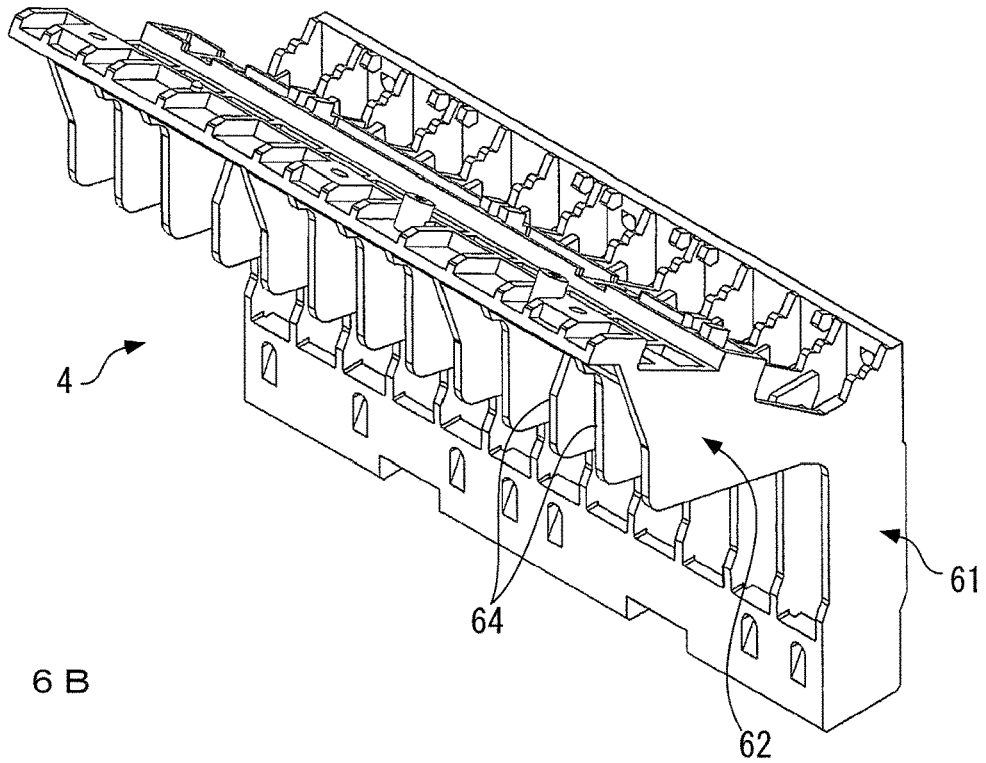
FIG. 6A is a perspective view of a whole hammer support for a one-octave section.
Figure 6B:
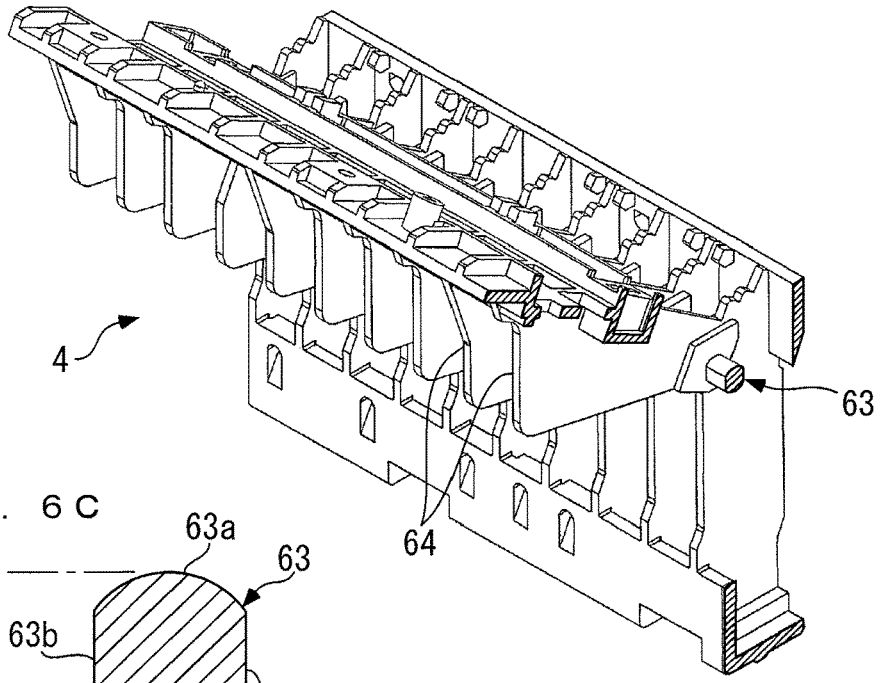
FIG. 6B is a perspective view of the hammer support shown in FIG. 6A in a state partially cut away.
Figure 6C:
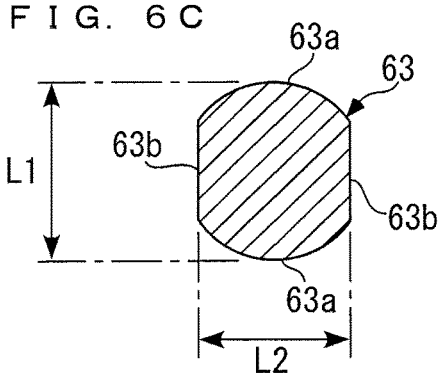
FIG. 6C is a cross-sectional view showing a hammer fulcrum shaft on an enlarged scale.
Figure 7A:
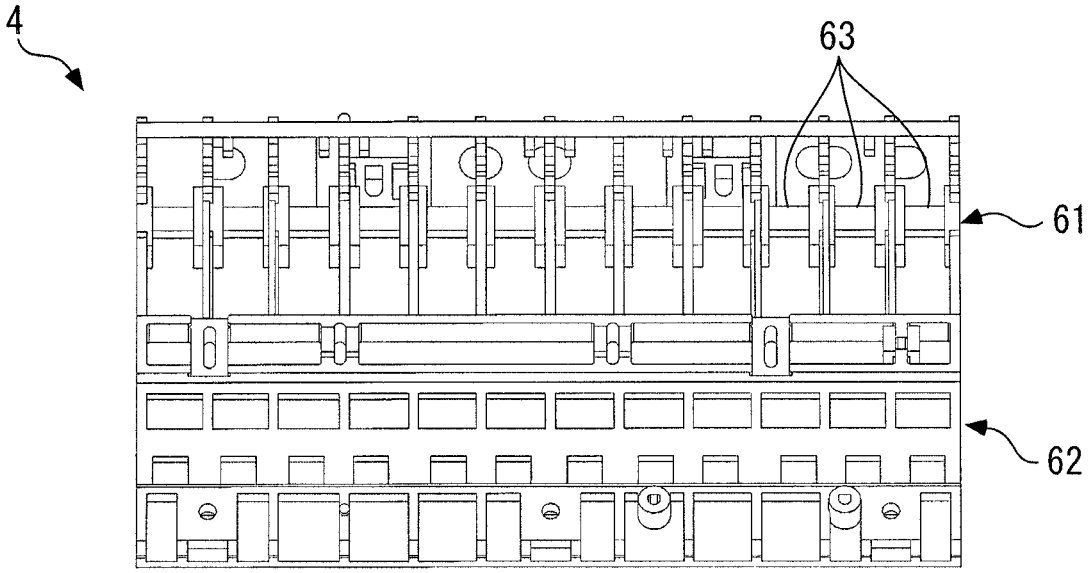
FIG. 7A is a plan view of the hammer support.
Figure 7B:
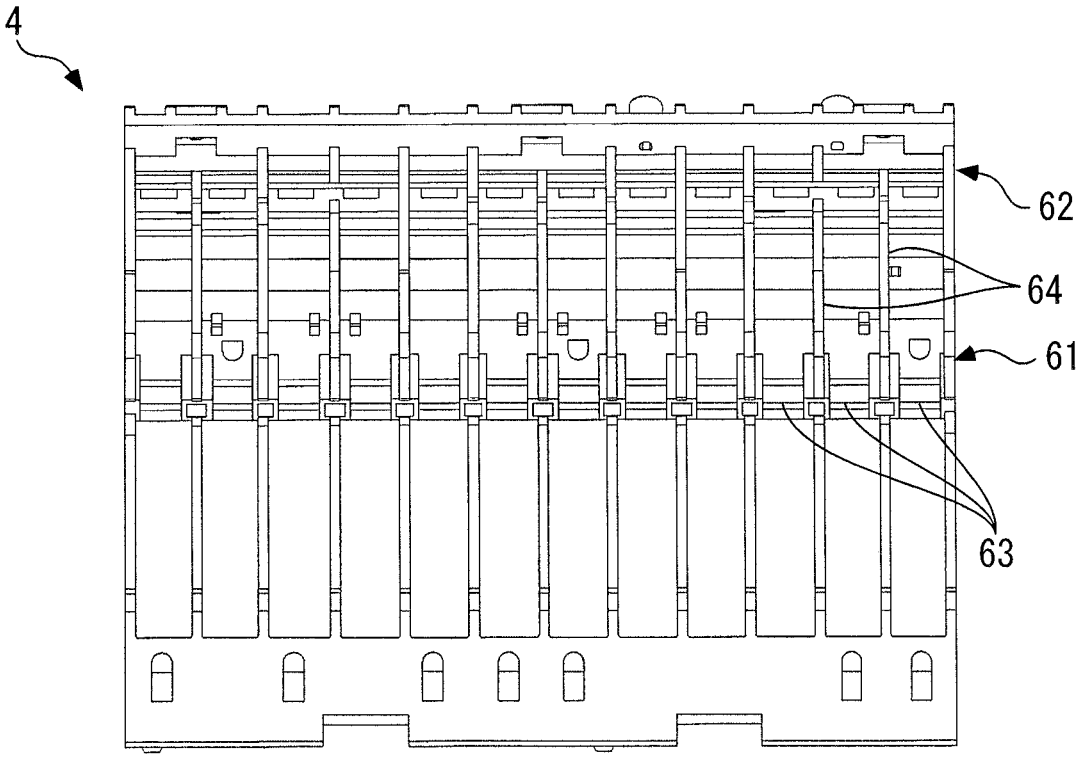
FIG. 7B is a front view of the hammer support shown in FIG. 7A.

Further, the hammer support 4 has a plurality of partition walls 64 for separating the hammers 5 adjacent to each other, with a predetermined spacing therebetween in the left-right direction, and each of the hammer fulcrum shafts 63 extends between each adjacent two of the partition walls 64 and 64 in the left-right direction. As shown in FIG. 6C, the hammer fulcrum shaft 63 has a cross-sectional shape formed in a so-called oval shape in which front and rear portions of a circle, the center of which corresponds to the axis of the hammer fulcrum shaft 63, are cut out.

Specifically, the hammer fulcrum shaft 63 has an outer peripheral surface formed by a pair of upper and lower curved surfaces 63*a* and 63*a* and a pair of front and rear flat surfaces 63*b* and 63*b* each extending between the curved surfaces 63*a* and 63*a*. In the hammer fulcrum shaft 63 formed as above, the upper and lower curved surfaces 63*a* and 63*a* are set as segments of a circle having a diameter of a length L1, and the distance between the front and rear flat surfaces 63*b* and 63*b* is set to a length L2 which is shorter than the length L1.

Figure 8:
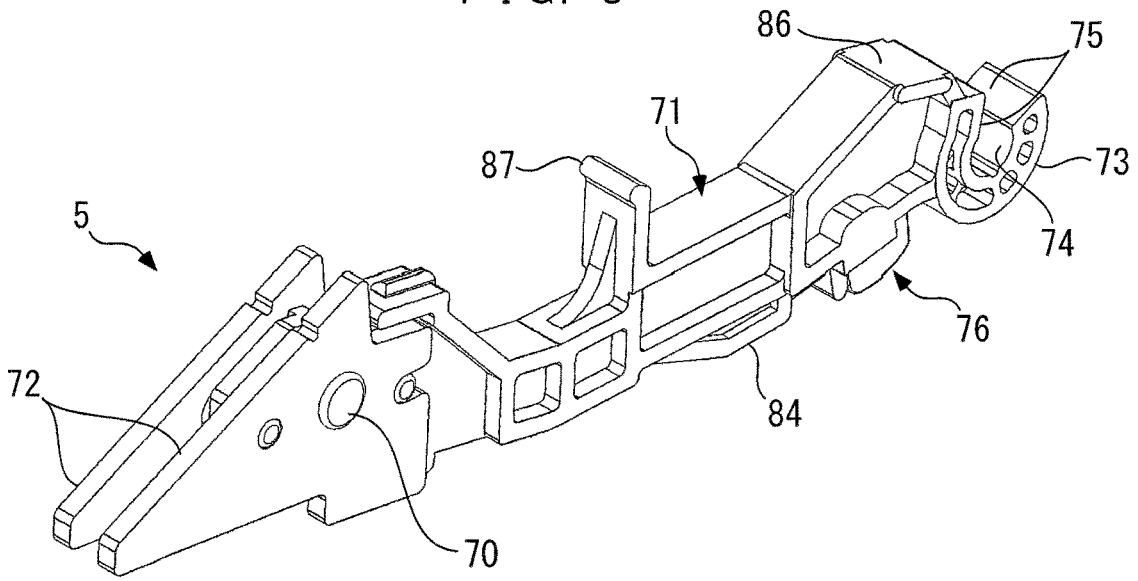
FIG. 8 is a perspective view of a hammer.
Figure 9A:
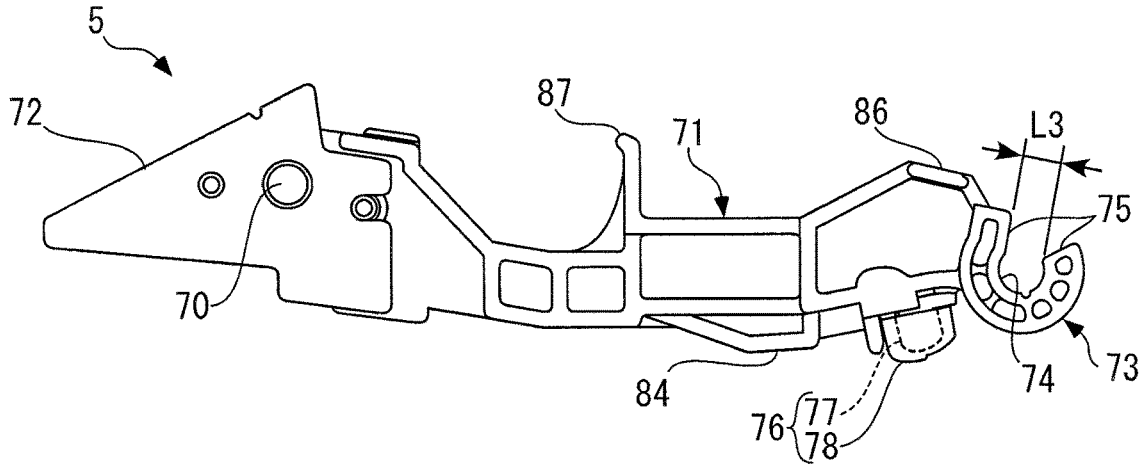

FIG. 8 and FIG. 9A show the hammer 5. As shown in FIG. 8 and FIG. 9A, the hammer 5 is comprised of an arm-like hammer body 71 extending in the front-rear direction and two weight plates 72 and 72 mounted to the front ends of the respective left and right side surfaces of the hammer body 71 with rivets 70. The hammer body 71 is made of a hard synthetic resin, and each of the weight plates 72 is made of a metal material, such as steel, having a relatively large specific gravity.

The hammer body 71 has a rear end formed with an engagement portion 73 for engagement with the hammer fulcrum shaft 63 of the hammer support 4. The engagement portion 73 has an arcuate shaft hole 74 formed in a C shape in side view, and the opening of the shaft hole 74 has front and rear guide surfaces 75 and 75 formed to expand outward. The shaft hole 74 has a diameter which is slightly larger than the diameter (length L1) of the circle partially formed by the upper and lower curved surfaces 63*a* and 63*a*, and the opening has a width L3 which is slightly larger than the length L2 between the front and rear flat surfaces 63*b* and 63*b* of the hammer fulcrum shaft 63 and smaller than the length L1. The hammer 5 can be mounted/removed to/from the hammer fulcrum shaft 63 of the hammer support 4 via the opening of the shaft hole 74, and the shaft hole 74 is engaged with the hammer fulcrum shaft 63, whereby the hammer 5 is pivotally supported by the hammer support 4.

Further, as shown in FIG. 9A, at a predetermined location on the rear portion of the bottom surface of the hammer 5, there is formed a key contact portion 76 (first contact portion) protruding downward for being brought into contact with the above-described hammer contact height-regulating portion 46 of the key 2 from above. The key contact portion 76 is comprised of a contact protrusion 77 integrally formed with the hammer body 71 of the hammer 5 and a protrusion cover 78 mounted to the hammer body 71 such that the protrusion cover 78 covers the contact protrusion 77.

Figure 9B:
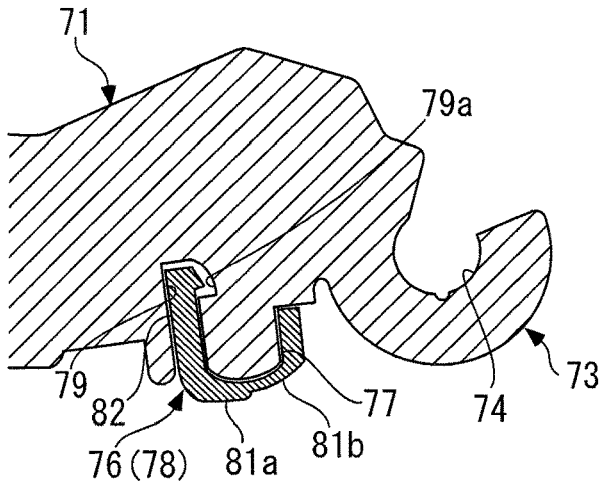

As shown in FIG. 9B, the contact protrusion 77 of the key contact portion 76 protrudes downward and has a lower surface formed in an arcuate shape. Further, a front upper portion of the contact protrusion 77 of the hammer body 71 is formed with a hook-receiving portion 79 that is engaged with a hook 82, referred to hereinafter, of the protrusion cover 78. The hook-receiving portion 79 is formed in a recessed shape open downward and has an upper end formed with an engaging recess 79*a*.

On the other hand, the protrusion cover 78 is formed as a molded article made of a predetermined resilient material (e.g. elastomer) and having a predetermined shape. Specifically, as shown in FIGS. 9B and 9C, the protrusion cover 78 is comprised of an cover body 81 open upward for accommodating the contact protrusion 77 in a state in which the cover body 81 covers the contact protrusion 77, and the hook 82 extending upward from a front end of the cover body 81 for engagement with the hook-receiving portion 79 of the hammer body 71.

Figure 9C:
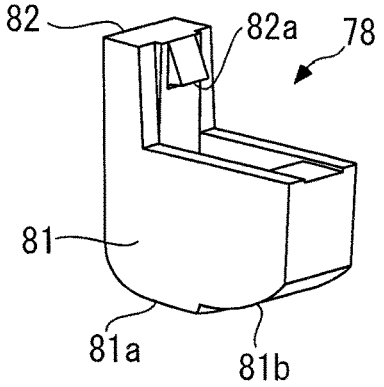

Further, as shown in FIGS. 9B and 9C, a front half portion (left half portion as viewed in FIG. 9B) of the bottom surface of the cover body 81 is formed with a front bottom portion 81*a* in an arcuate shape having a relatively large curvature radius, and on the other hand, a rear half portion of the bottom surface thereof is formed with a rear bottom portion 81*b* in an arcuate shape having a curvature radius smaller than that of the front bottom portion 81*a*. The rear bottom portion 81*b* is formed by cutting out a portion of the rear half portion of the bottom of the cover body 81 such that the rear bottom portion 81*b* is positioned inward (upward, as viewed in FIG. 9C) of an imaginary line obtained by extending the arcuate outline of the front bottom portion 81*a* rearward, to thereby form a step from the front bottom portion 81*a*.

Furthermore, an upper end of the hook 82 of the protrusion cover 78 is formed with a lug 82*a*. This lug 82*a* is engaged with the engaging recess 79*a* of the hook-receiving portion 79, whereby the protrusion cover 78 is securely mounted to the hammer body 71 in a state fitted on the contact protrusion 77.

As shown in FIG. 8 and FIG. 9A, the cushion contact portion 84 (second contact portion or predetermined portion) for abutment with the hammer cushion 47 secured to the rear end of the upper surface of the key 2 is provided on the bottom surface of the hammer body 71. The cushion contact portion 84 is formed at a predetermined location forward of the key contact portion 76 (immediately forward of the same) and has a lower surface formed flat.

Further, at a location forward and upward of the engagement portion 73 of the rear end of the hammer body 71, there is formed an actuator portion 86 for actuating the key switch 7 by pressing the same in response to key depression. Furthermore, an engagement protrusion 87 having a plate shape is protrudingly formed on the upper surface of the hammer body 71 at a location at about the center thereof in the front-rear direction, for engagement with the let-off member 6 during key depression.

As shown in FIGS. 1A and 1B, the key switch 7 is comprised of a switch board 7*a* formed by a printed circuit board and switch bodies 7*b* each formed by a rubber switch and provided on the lower surface of the switch board 7*a* for an associated one of the keys 2. The switch board 7*a* has a rear end thereof inserted into the switch-mounting portion 62 of the hammer support 4 and screwed to the same. In the key-released state, each of the switch bodies 7*b* is opposed to the actuator portion 86 of the associated hammer 5 with a spacing therefrom.

Each of the let-off members 6 is formed as a molded article made of a resilient material having a predetermined shape, and is mounted to the switch-mounting portion 62 of the hammer support 4 as shown in FIG. 1B. The let-off member 6 extends downward and rearward from the switch-mounting portion 62 and has a head 6*a* formed on a tip end thereof via a neck portion. In the key-released state, the head 6*a* is opposed to the engagement protrusion 87 of the hammer 5.

Further, as shown in FIGS. 1A and 1B, on the bottom surface of the front end of the switch-mounting portion 62 of the hammer support 4, there is provided a hammer stopper 88 for restricting upward pivotal motion of the hammer 5. The hammer stopper 88 is attached to the switch-mounting portion 62 such that it extends in the left-right direction.

Next, a description will be given of the operation of the keyboard device 1 constructed as above. When the key 2 is depressed in the key-released state shown in FIGS. 1A and 1B, the key 2 pivotally moves about the balance rail pin 13 in the counterclockwise direction as viewed in FIG. 1B, and in accordance with this motion of the key 2, the hammer 5 is pushed up via the key contact portion 76 and pivotally moves upward (in the clockwise direction as viewed in FIG. 1B) about the hammer fulcrum shaft 63.

The engagement protrusion 87 engages the head 6*a* of the let-off member 6 during the pivotal motion of the hammer 5 and presses the let-off member 6 via the head 6*a* while compressing the same, whereby a reaction force acting on the hammer 5 from the let-off member 6 increases. When the hammer 5 further pivotally moves, the engagement protrusion 87 is disengaged from the head 6*a*, whereby the reaction force from the let-off member 6 abruptly disappears. Such an increase and a disappearance of the reaction force from the let-off member 6 gives a let-off feeling analogous to one given by an acoustic piano.

Thereafter, a front portion of the hammer 5 comes into abutment with the hammer stopper 88 located above, whereby the upward pivotal motion of the hammer 5 is terminated (pivotally-moved position). During the upward pivotal motion of the hammer 5, the actuator portion 86 of the hammer 5 presses the switch body 7*b* of the key switch 7 to thereby turn on the key switch 7, whereby key depression information of the key 2 is detected according to the amount of pivotal motion of the hammer 5 and output to a tone generation controller (not shown). Then, the tone generation controller controls tone generation of the electronic piano according to the detected key depression information.

Figure 10A:
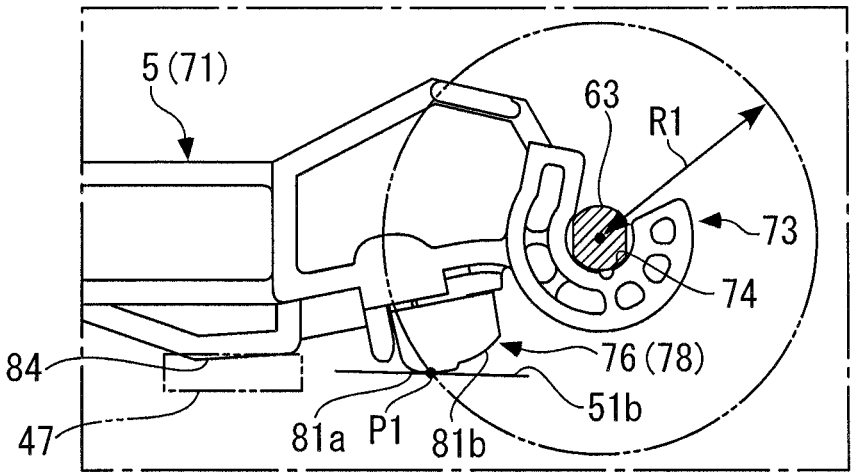
Figure 10B:
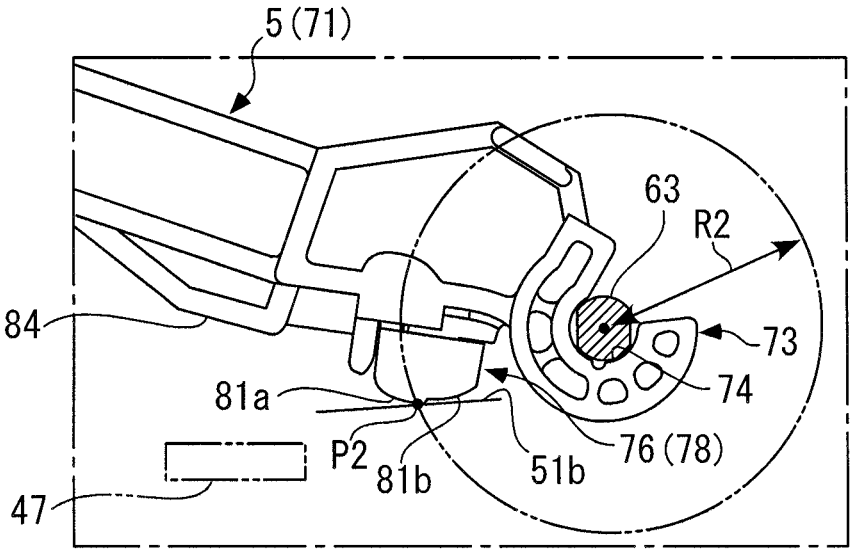

Now, a description will be given, with reference to FIG. 10A to FIG. 12, of a state of contact between the key 2 and the hammer 5 and a touch weight felt during key depression. FIG. 10A shows a contact position of the hammer 5 on the key 2 in the key-released state, and FIG. 10B shows a contact position of the hammer 5 on the key 2 in the key-depressed state. More specifically, FIGS. 10A and 10B show the contact position of the key contact portion 76 of the hammer 5 on the hammer-receiving portion 51*b* (only the position on the upper surface of the hammer-receiving portion 51*b* is shown in FIG. 10A to FIG. 11B) of the hammer contact height-regulating portion 46 of the rear end of the key 2. As shown in FIG. 10A, in the key-released state, the key contact portion 76 of the hammer 5 is in contact with the hammer-receiving portion 51*b* of the key 2 at a predetermined position P1 of the front bottom portion 81*a* of the bottom surface of the protrusion cover 78. In this case, the distance between the axis of the hammer fulcrum shaft 63 of the hammer support 4 and the predetermined position P1 is R1. Further, in this case, the cushion contact portion 84 of the hammer 5 is placed on the hammer cushion 47 of the key 2.

Further, as shown in FIG. 10B, in the key-depressed state, the key contact portion 76 of the hammer 5 is in contact with the hammer-receiving portion 51*b* of the key 2 at a predetermined position of the front bottom portion 81*a* of the bottom surface of the protrusion cover 78, more specifically at a predetermined position P2 of the rear end of the front bottom portion 81*a* slightly rearward of the predetermined portion P1. In this case, a distance R2 between the axis of the hammer fulcrum shaft 63 of the hammer support 4 and the predetermined position P2 is approximately equal to the distance R1 in the key-released state (R2 R1). This means that during time from the start of depression of the key 2 to the termination of the key depression (i.e. state in which the key 2 has been fully depressed), the distance between a point of contact between the hammer-receiving portion 51*b* of the key 2 and the key contact portion 76 of the hammer 5, i.e. a point of action of the key 2 on the hammer 5, and the axis of the hammer fulcrum shaft 63 is held approximately constant.

Figure 11A:
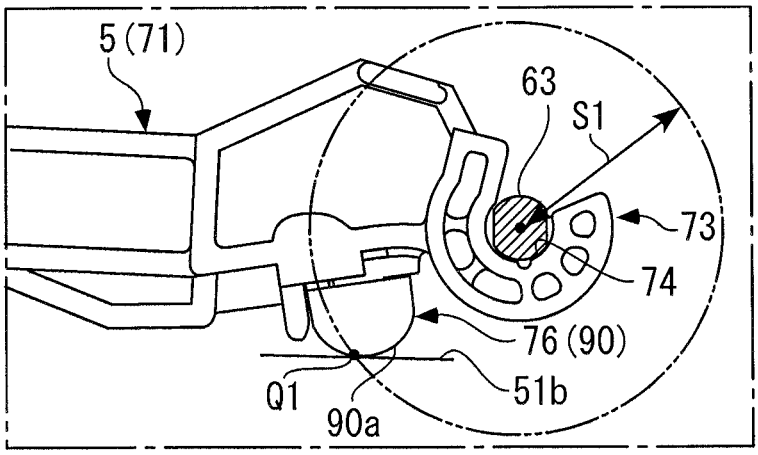
FIGS. 11A and 11B are enlarged views corresponding, respectively, to FIGS. 10A and 10B, which show a rear end of a comparative example of the hammer.
Figure 11B:
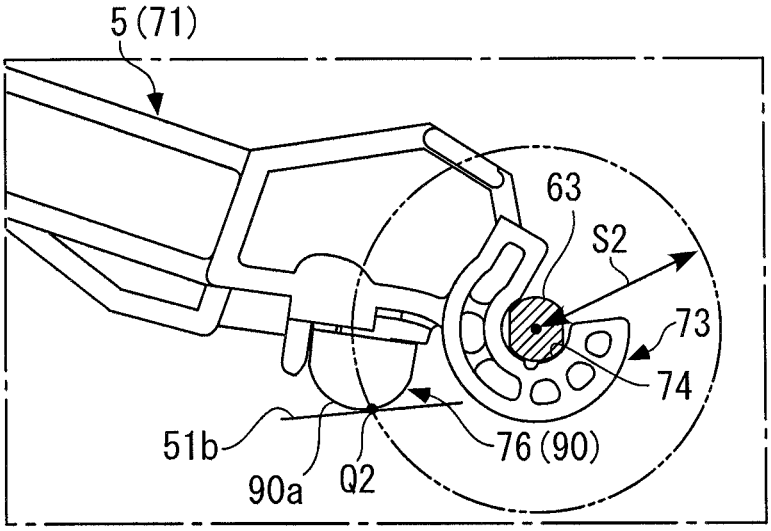

On the other hand, FIGS. 11A and 11B correspond, respectively, to FIGS. 10A and 10B, and show a comparative example of the hammer 5 in which a protrusion cover 90 having a smooth bottom surface formed as a bottom portion 90*a* having an arcuate shape is used in the key contact portion 76 in place of the protrusion cover 78 having its bottom formed with the step as shown in FIGS. 10A and 10B, and also, the hammer cushion 47 is omitted from the rear end of the upper surface of the key 2. In the key-released state shown in FIG. 11A, the key contact portion 76 of the hammer 5 is in contact with the hammer-receiving portion 51*b* of the key 2 at a predetermined position Q1 of a front portion of the bottom portion 90*a* of the protrusion cover 90. In this case, a distance S1 between the axis of the hammer fulcrum shaft 63 of the hammer support 4 and the predetermined position Q1 is approximately equal to the distance R1 indicated in FIG. 10A (S1≈R1).

Further, in the key-depressed state shown in FIG. 11B, the key contact portion 76 of the hammer 5 is in contact with the hammer-receiving portion 51*b* of the key 2 at a predetermined position Q2 of a rear portion of the bottom portion 90*a* of the protrusion cover 90. In this case, a distance S2 between the axis of the hammer fulcrum shaft 63 and the predetermined position Q2 is shorter than the distance S1 (S2<S1). This means that in the comparative example in which the protrusion cover 90 is applied to the key contact portion 76 of the hammer 5, during time from the start of depression of the key 2 to the termination of the key depression, the distance between the point of action of the key 2 on the hammer 5 and the axis of the hammer fulcrum shaft 63 is progressively reduced.

Figure 12:
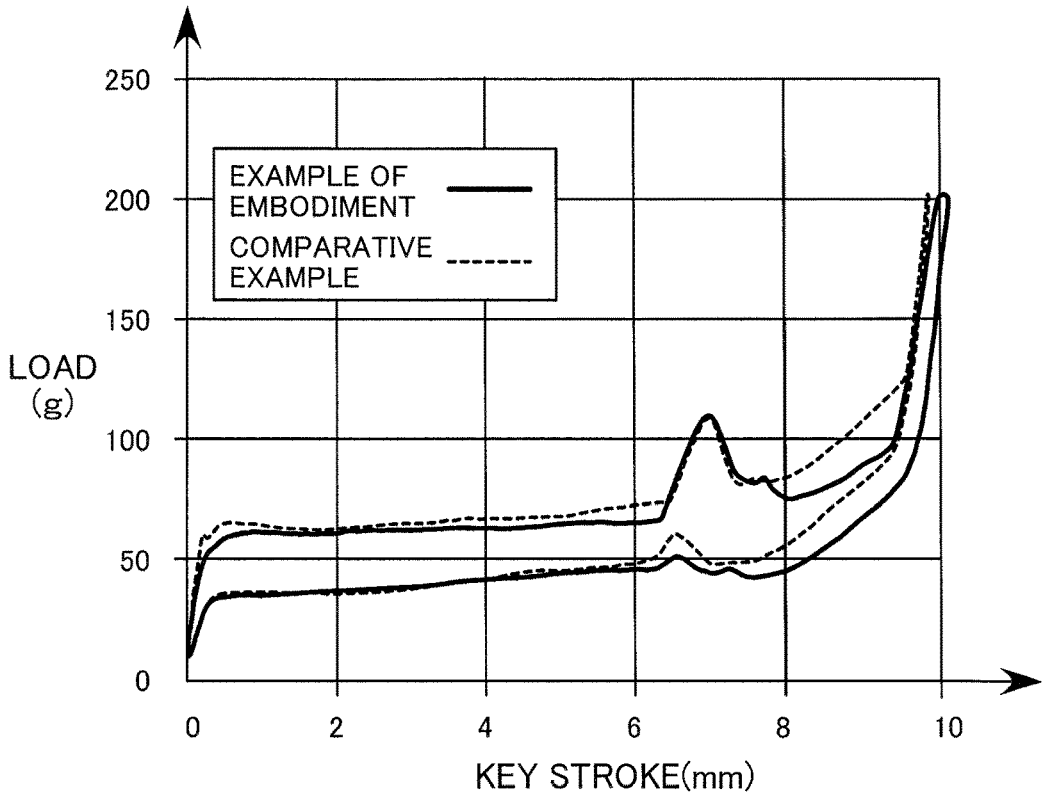
FIG. 12 is a diagram showing an example of the embodiment and a comparative example of changes in load dependent on key stroke from the start of key depression of a key to the end of release of the key.

FIG. 12 shows examples of a keystroke as a downward shift of the front end of the key 2 during key depression and changes in load felt as touch weight dependent on the keystroke during time from the start of key depression to the termination of key release, with respect to each of an example of the present embodiment (solid lines) and a comparative example (broken lines). As shown in FIG. 12, in a range from 0 mm to approximately 6 mm of the keystroke, there is no large difference between the example of the embodiment and the comparative example. Further, in a range from approximately 6 mm to approximately 8 mm of the keystroke, let-off feeling is generated by an increase and a disappearance of the reaction force from the let-off member 6, and therefore it is possible to obtain similar let-off feeling in both of the example of the embodiment and the comparative example.

Further, within a range from approximately 8 mm to approximately 9 mm of the keystroke, an increase in the load in the comparative example is larger than in the example of the embodiment. This means that in the comparative example, immediately after impartment of let-off feeling, the player feels the key 2 heavy in depression thereof. In contrast, in the example of the embodiment, immediately after impartment of let-off feeling, the increase in the load is more gentle than in the comparative example, and therefore it is possible to give a touch feeling analogous to that of an acoustic piano without making the key 2 felt heavy in depression thereof. Note that in a range from approximately 9 mm to approximately 10 mm of the keystroke, the load sharply increases because the hammer 5 pivotally moved upward comes into abutment with the hammer stopper 88, whereby further upward pivotal motion thereof is blocked.

When the key 2 is released after termination of the key depression, the hammer 5 having been pivotally moved upward pivotally moves downward by its own weight to press the rear end of the key 2 downward via the key contact portion 76. This causes the key 2 to pivotally move in the opposite direction to the direction of its pivotal motion performed during the key depression and return to the key-released state shown in FIGS. 1A and 1B. Further, in this case, the cushion contact portion 84 of the hammer 5 comes into abutment with the hammer cushion 47 of the key 2 from above, whereby the bouncing of the hammer 5 is suppressed.

Figure 13:
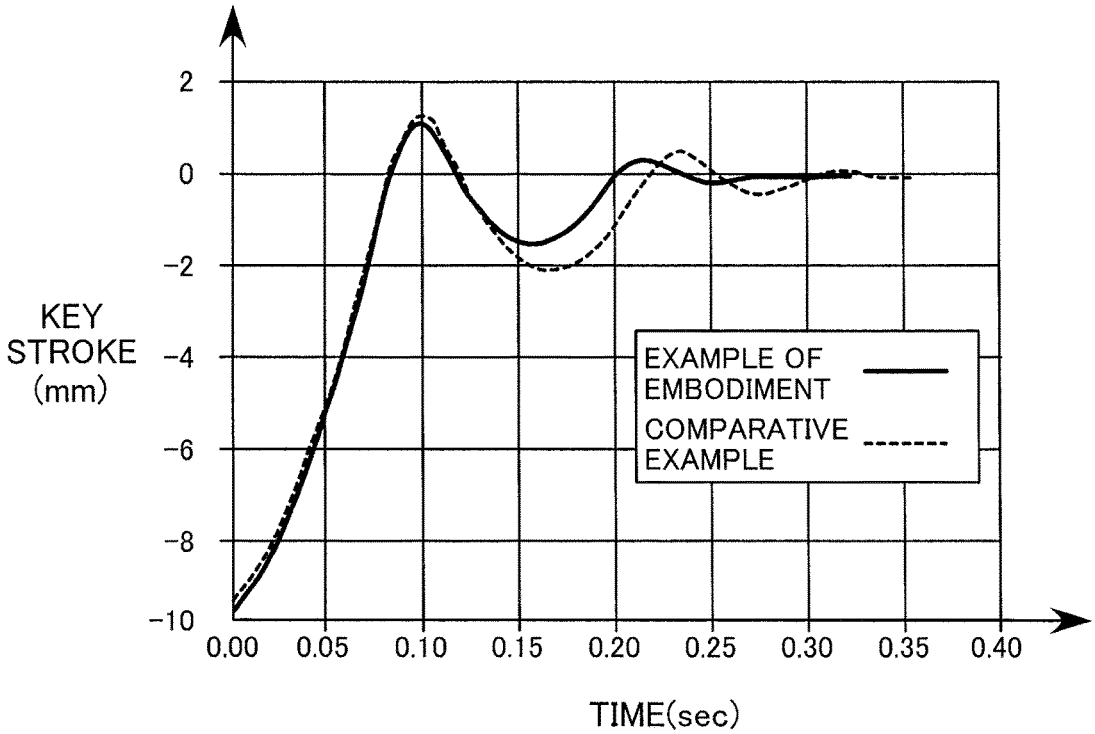
FIG. 13 is a diagram showing an example of the embodiment and a comparative example of changes in key stroke which occur during return of a key to its original position after release of a key in a fully key-depressed state.

FIG. 13 shows examples of changes in the keystroke of the key 2 during return of the same to its original position due to key release in the fully-depressed state, with respect to each of the example of the embodiment (solid lines) and the comparative example (broken lines) in which the hammer cushion 47 is omitted from the rear end of the upper surface of the key 2. Note that a position indicated by a keystroke of 0 mm in FIG. 13 corresponds to a position of the key 2 in the key-released state (hereinafter referred to as "the reference position").

When release of the key 2 is started in the fully-depressed state thereof, the front end of the key 2 moves up and then the key 2 vertically vibrates about the reference position and then stops, in both of the example of the embodiment and the comparative example, as shown in FIG. 13. This vibration of the key 2 occurs in accordance with vertical bouncing of the hammer 5 caused by a force generated when the hammer 5 having been pivotally moved upward pivotally moves downward to return to its original position.

In the comparative example, the hammer cushion 47 is not provided on the rear end of the upper surface of the key 2 as described hereinbefore, so that when the hammer 5 is on the point of returning to its original position after having been pivotally moved upward, the vertical bouncing of the hammer 5 cannot be suppressed. For this reason, the key 2 in the comparative example vertically vibrates relatively largely about its reference position as indicated by the broken line in FIG. 13, and therefore it takes longer time before the vibration of the key 2 is stopped.

On the other hand, in the example of the embodiment, on the point of returning to its original position after having been pivotally moved upward, the hammer 5 comes into abutment with the hammer cushion 47 from above, whereby the bouncing thereof is suppressed. As a consequence, as indicated by the solid line in FIG. 13, the vibration of the key 2 about the reference position is suppressed in the example of the embodiment differently from the comparative example, and therefore it takes shorter time before the bouncing of the key 2 is stopped.

As described heretofore in detail, according to the present embodiment, the hammer 5 having pivotally moved upward in accordance with depression of the key 2 pivotally moves downward in accordance with key release to come into abutment with the hammer cushion 47 on the rear end of the upper surface of the key 2 via the cushion contact portion 84 on the point of returning to its original position. This makes it possible to suppress the bouncing of the hammer 5 on the point of returning to its original position, and consequently the key 2 returns in a shorter time to its original position where it was before key depression, which makes it possible to play quickly, whereby it is possible to enjoy excellent playability of the electronic musical instrument.

Further, the hammer cushion 47 is provided on the rear end of the upper surface of the key 2 (i.e. on the upper piece-fixing portion 51*a* of the hammer contact height-regulating portion 46), and in addition, the cushion contact portion 84 of the hammer 5 for abutment with the hammer cushion 47 is provided at a location immediately forward of the key contact portion 76 that works as a point of action for pivotally moving the hammer 5 by the key 2. This makes it possible not only to bring the hammer 5 into abutment with the hammer cushion 47 in a relatively shorter time e.g. when the hammer 5 returns to its original position, but also to reduce impact applied to the hammer cushion 47 compared with the case where the hammer 5 is configured such that the front end of the lower surface hereof is brought into abutment with the hammer cushion. Consequently, it is possible to obtain an effect of suppressing the bouncing of the hammer 5 within a relatively wide range of pivotal motion when the hammer 5 returns to its original position as well as to use the hammer cushion 47 over a long term.

Furthermore, when the hammer 5 pivotally moves, only the front bottom portion 81*a* of the key contact portion 76 of the hammer 5 comes into contact with the rear end of the upper surface of the key 2 (i.e. the hammer-receiving portion 51*b* of the hammer contact height-regulating portion 46), so that the distance between the contact portion and the axis of the hammer fulcrum shaft 63 of the hammer support 4 is approximately constant. This makes it possible to suppress an increase in load applied to the key 2 from the hammer 5 when the hammer 5 is pivotally moved in accordance with key depression. As a consequence, even when the player performs soft key striking in which the key 2 is slowly depressed during musical performance, the player does not feel the key 2 heavy, and therefore it is possible to enjoy excellent playability of the electronic musical instrument.

The long-term use of the electronic piano sometimes causes the hammer cushion 47 to be progressively crushed by being repeatedly pressed by the hammer 5, resulting in a lowered level of the upper surface of the hammer cushion 47. However, since the front bottom portion 81*a* of the key contact portion 76 of the hammer 5 is formed in an arcuate shape having a relatively large curvature radius, the level of contact between the hammer 5 and the key 2 changes little even when the level of the upper surface of the hammer cushion 47 is lowered, which makes it possible to maintain the hammer 5 in a correct posture in the key-released state over a long term.

As described above in detail, according to the present embodiment, in adjacent two of the plurality of keyframe front molded articles 21 to be connected to one another, the right connecting portion 23 of one keyframe front molded article 21 of the two is formed with the connecting engagement protrusion 26 having a lateral T shape in plan view, and the left connecting portion 24 of the other keyframe front molded article 21 is formed with the connecting engagement recess 27 for engagement with the connecting engagement protrusion 26. This connecting engagement recess 27 is formed in a recessed shape that can be vertically fitted with the shape, in plan view, of the connecting engagement protrusion 26, and is engaged with the connecting engagement protrusion 26 in a state immovable relative to the connecting engagement protrusion 26 in the left-right direction and the front-rear direction. By thus engaging the connecting engagement protrusion 26 and the connecting engagement recess 27 in a state fitted to each other, it is possible to connect the adjacent two keyframe front molded articles 21 and 21 to each other by their own mechanical connection, so that even when the keyframe front molded articles 21 expand or contract due to thermal expansion or contraction, solid connection between the two keyframe front molded articles 21 and 21 can be maintained. As described above, according to the present embodiment, it is possible to maintain solid connection between each adjacent two of the keyframe front molded articles 21 and 21 over a long term to thereby prevent occurrence of variation in gap between the keys 2 in the keyboard device 1.

Further, the connecting engagement protrusion 26 and the connecting engagement recess 27 are not only engaged with each other, but also secured to each other in a state bonded in the vertical direction using the adhesive, which makes it possible to achieve further solid connection between the adjacent keyframe front molded articles 21 and 21. In addition, since the adhesive is injected through the plurality of adhesive injection holes 29 and then flows into the grooves 29*a* continuous with each of the adhesive injection holes 29 and radially extending therefrom. This makes it possible to stably supply the adhesive to a relatively wide range between the connecting engagement protrusion 26 and the connecting engagement recess 27 superposed one upon the other, in a well-balanced manner as a whole, which makes it possible to solidly bond the connecting engagement protrusion 26 and the connecting engagement recess 27 to each other.

Furthermore, since the connecting engagement protrusion 26 and the connecting engagement recess 27 bonded to each other by the adhesive are screwed to each other with the swaging screw 31 in a state vertically secured to each other by swaging, it is possible to more solidly bond the connecting engagement protrusion 26 and the connecting engagement recess 27 to each other and stably maintain the resultant state over a long term.

What is more, while the connecting engagement protrusion 26 is formed with the screw protrusion 26*c*, the connecting engagement recess 27 is formed with the insertion hole 27*c*, so that work for assembling the keyframe front molded articles 21 and 21 can be carried out with relative ease by fitting the connecting engagement protrusion 26 and the connecting engagement recess 27 with each other while inserting the screw protrusion 26*c* into the insertion hole 27*c*. Further, since the connecting engagement protrusion 26 and the connecting engagement recess 27 are not only fitted with each other, but also the screw protrusion 26*c* is inserted into the insertion hole 27*c*, it is possible to more solidly connect the keyframe front molded articles 21 and 21 in a state immovable relative to each other in the left-right direction and the front-rear direction.

Note that the present invention is not limited to the above-described embodiment, but it can be practiced in various forms. For example, although in the above-described embodiment, the hammer cushion 47 is provided on the rear end of the upper surface of the key 2, this is not limitative, but it is possible to provide a member similar to the hammer cushion 47 in the cushion contact portion 84 of the hammer 5 in place of the hammer cushion 47.

Further, although in the embodiment, in the key contact portion 76 of the hammer 5, the bottom of the protrusion cover 78 is formed with the front bottom portion 81*a* that can be brought into contact with the key 2 and the rear bottom portion 81*b* that cannot be brought into contact with the key 2, this is not limitative, but such portions can be formed integrally on the hammer body 71.

Furthermore, although the hammer cushion 47 is made of soft urethane foam by way of example, this is not limitative, but any other material can be adopted, insofar as it is capable of suppressing the bouncing of the hammer 5 on the point of returning, after key release, to its original position where it was before key depression.

What is more, although in the embodiment, the connecting engagement protrusion 26 of the keyframe front molded article 21 is formed in a lateral T shape in plan view, it is possible to configure the connecting engagement protrusion 26 such that the increased-width portion 26*b* on the tip end of the reduced-width portion 26*a* protrudes only either forward or rearward, for example, to thereby form the connecting engagement protrusion 26 into an L shape in plan view. As far as the shape, in plan view, of the connecting engagement protrusion 26 is concerned, it is possible to adopt any of various shapes that allows adjacent keyframe front molded articles 21 and 21 to be interconnected in a state immovable relative to each other in the left-right direction.

The detailed structure of each of the keyboard device 1, the key 2, the hammer 5, the key contact portion 76, the keyframe front 11, and the keyframe front molded article 21 is described only by way of example, and it can be modified, as desired, within the scope of the subject matter of the present invention.

It is further understood by those skilled in the art that the foregoing are preferred embodiments of the invention, and that various changes and modifications may be made without departing from the spirit and scope thereof.

What is claimed is:

1. A keyboard device for an electronic keyboard instrument, comprising:

a key extending in a front-rear direction and configured to be swingable about a key fulcrum located at about a center of the key in a longitudinal direction thereof;

a hammer extending in the front-rear direction and configured to be pivotally movable in a vertical direction between an initial position and a pivotally-moved position about a hammer fulcrum provided at about a rear end of the key, the hammer being placed on the key via a first contact portion brought into contact with a rear end of an upper surface of the key from above, for being pivotally moved in accordance with swinging of the key; and a hammer bounce-suppressing member provided on one of the upper surface of the key and a lower surface of the hammer at a predetermined position forward of the first contact portion and configured to suppress bouncing of the hammer by being brought into contact with the other of the upper surface of the key and the lower surface of the hammer when the hammer returns from the pivotally-moved position to the initial position in accordance with release of the key depressed.

2. The keyboard device according to claim 1, wherein the hammer includes a second contact portion provided immediately forward of the first contact portion, and wherein the hammer bounce-suppressing member is provided on the rear end of the upper surface of the key, and the second contact portion is in abutment with the hammer bounce-suppressing member from above when the hammer is in the initial position.

3. The keyboard device according to claim 1, wherein the hammer bounce-suppressing member is made of urethane foam having a predetermined resilience.

4. A keyboard device for an electronic keyboard instrument, including:

a key extending in a front-rear direction and configured to be swingable about a key fulcrum located at about a center of the key in a longitudinal direction thereof, and a hammer extending in the front-rear direction and having a rear end thereof supported such that the hammer is pivotally movable in a vertical direction about a hammer fulcrum provided at about a rear end of the key, the hammer being placed on a rear end of an upper surface of the key, for being pivotally moved in accordance with swinging of the key, wherein the hammer comprises:

a hammer body extending in the front-rear direction and having a rear end thereof pivotally movable about the hammer fulcrum; and a key contact portion provided such that the key contact portion protrudes downward from a rear end of a lower surface of the hammer body and configured to be brought into contact with the rear end of the upper surface of the key from above, and wherein the key contact portion is configured such that during pivotal motion of the hammer, a distance between a contact portion thereof in contact with the upper surface of the key and the hammer fulcrum is approximately constant.

5. The keyboard device according to claim 4, wherein the key contact portion has a bottom formed in an approximately arcuate shape in side view, and wherein the bottom comprises a front bottom portion that forms a front half of the bottom and can be brought into contact with the key and a rear bottom portion that forms a rear half of the bottom and cannot be brought into contact with the key.

6. The keyboard device according to claim 5, further comprising a hammer cushion provided immediately forward of the key contact portion on the rear end of the upper surface of the key and configured such that in a key-released state, a predetermined portion of the lower surface of the hammer is in abutment with the hammer cushion from above, and wherein the front bottom portion is formed in an arcuate shape which has a predetermined curvature radius so as to maintain the hammer in the key-released state in substantially the same posture before and after the hammer cushion undergoes aging deformation.

7. The keyboard device according to claim 4, wherein the key contact portion comprises:

a contact protrusion integrally formed with the hammer body and having a protruding shape protruding downward, and a protrusion cover having the front bottom portion and the rear bottom portion and removably mounted on the contact protrusion.

8. A keyframe front for a keyboard instrument, which is formed to extend in a left-right direction, by interconnecting ends of a plurality of keyframe front molded articles each made of a synthetic resin and extending in the left-right direction, and on which a plurality of front rail pins for engagement with front ends of a plurality of keys, respectively, are erected in a state arranged side by side in the left-right direction, wherein one keyframe front molded article of each adjacent two of the keyframe front molded articles has an end thereof provided with a connecting engagement protrusion protruding toward the other keyframe front molded article adjacent thereto and having a predetermined shape in plan view, and the other keyframe front molded article has an end thereof provided with a connecting engagement recess which is formed in a recessed shape fittable with the shape in plan view of the connecting engagement protrusion and engages the connecting engagement protrusion in a state immovable relative to the connecting engagement protrusion in the left-right direction.

9. The keyframe front according to claim 8, wherein the connecting engagement protrusion includes a first protrusion having a predetermined width in a front-rear direction and extending over a predetermined length in the left-right direction, and a second protrusion provided on a tip end of the first protrusion and protruding over a predetermined length at least in one of a forward direction and a rearward direction.

10. The keyframe front according to claim 8, comprising fixing means for fixing the connecting engagement protrusion and the connecting engagement recess to each other in a state held in intimate contact with each other in a vertical direction.

11. The keyframe front according to claim 10, wherein the fixing means includes an adhesive for bonding the connecting engagement protrusion and the connecting engagement recess to each other in the vertical direction.

12. The keyframe front according to claim 11, wherein one of the connecting engagement protrusion and the connecting engagement recess has at least one adhesive injection hole formed therethrough in the vertical direction and has a plurality of grooves formed on a flat surface thereof in contact with the other of the connecting engagement protrusion and the connecting engagement recess such that the plurality of grooves are continuous with the adhesive injection hole and extend radially therefrom.

13. The keyframe front according to claim 11, wherein the fixing means further includes a fixing screw for screwing the connecting engagement protrusion and the connecting engagement recess to each other in a state fixed in the vertical direction by swaging.

14. The keyframe front according to claim 13, wherein the connecting engagement protrusion has a screw protrusion formed in a shape protruding in the vertical direction and having a screw hole formed inside for having the fixing screw screwed therein, and wherein the connecting engagement recess has an insertion hole formed therethrough in the vertical direction for having the screw protrusion inserted therein.

* * * * *